US006593071B2

(12) United States Patent
Kondo et al.

(10) Patent No.: US 6,593,071 B2
(45) Date of Patent: Jul. 15, 2003

(54) SILVER HALIDE PHOTOGRAPHIC EMULSION AND SILVER HALIDE PHOTOGRAPHIC LIGHT SENSITIVE MATERIAL

(75) Inventors: Toshiya Kondo, Hino (JP); Tadahiro Nagasawa, Hino (JP); Kuniaki Uezawa, Hino (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 09/952,161

(22) Filed: Sep. 14, 2001

(65) Prior Publication Data

US 2002/0061478 A1 May 23, 2002

(30) Foreign Application Priority Data

Sep. 18, 2000 (JP) ..... 2000-281888

(51) Int. Cl.[7] ..... G03C 1/005; G03C 1/494
(52) U.S. Cl. ..... 430/567; 430/569
(58) Field of Search ..... 430/505, 567, 430/569

(56) References Cited

U.S. PATENT DOCUMENTS 5,709,988 A * 1/1998 Black et al. ..... 430/567
5,780,216 A 7/1998 Ihama
6,080,535 A * 6/2000 Kondo ..... 430/567
6,235,460 B1 * 5/2001 Takada et al. ..... 430/567
6,287,753 B1 * 9/2001 Ihama et al. ..... 430/567
6,329,131 B1 * 12/2001 Morimura ..... 430/567

FOREIGN PATENT DOCUMENTS

EP 0616251 9/1994

OTHER PUBLICATIONS

European Search Report EP 01 30 7892.

* cited by examiner

*Primary Examiner*—Geraldine Letscher

(57) ABSTRACT

A silver halide emulsion is disclosed, comprising tabular grains having dislocation lines in the fringe portion, the tabular grains comprising a silver halide phase (V3) having a maximum iodide content, a silver halide phase (V6), internal to V3, having an average iodide content of A6 mol %, and a silver halide phase (V7), external to V3, having an average iodide content of A7 mol %, and $0 \leqq A6/A7 \leqq 1.0$; and wherein the dislocation line forming region comprises a shell accounting for 10 to 50% by volume of the grain and having an average iodide content of 4 to 20 mol %; the shell comprising an outermost sub-shell accounting for to 15% by volume of the grain and having an average iodide content of 0 to 3 mol %.

14 Claims, No Drawings

SILVER HALIDE PHOTOGRAPHIC EMULSION AND SILVER HALIDE PHOTOGRAPHIC LIGHT SENSITIVE MATERIAL

FIELD OF THE INVENTION

The present invention relates to silver halide photographic materials and silver halide photographic emulsion, and in particular to a silver halide photographic material and silver halide photographic emulsion which are improved in sensitivity reduction and deterioration in image quality, due to radiation.

BACKGROUND OF THE INVENTION

Recently, desire for optimal performance of silver halide color photographic materials has become severe, and photographic characteristics such as sensitivity, fog and graininess and storage stability are demanded at higher levels. As a result of recent popularization of compact zoom cameras and lens-fitted cameras used as a single use camera, photographing instruments and materials are carried to various locations and expected to be placed under severe conditions (such as being allowed to stand inside cars in the summer season). Accordingly, in photographing materials, higher performance is required for storage stability before exposure or over the period of from exposure to being processed. However, conventional techniques are insufficient for such requirements and further improvements are desired.

Along with recent trends of speed enhancement of photographic materials, there are concerns about problems such as increased fogging, speed-reduction and deterioration in graininess of silver halide photographic materials, caused by baggage checks using X-rays in air terminals. Increased fogging, speed reduction and graininess deterioration during storage, specifically caused by trace amounts of radiation in environments has become problematic. It is known that these influences caused by radiation can be reduced to some extent by reduction of silver coverage per unit area of photographic material. However, reduced silver coverage also results in a lowering of sensitivity and deterioration of image quality and there are limits to be compatible with prevention of deterioration in performance caused by radiation.

SUMMARY OF THE INVENTION

Accordingly, it is an object of the present invention to provide a silver halide photographic material and a silver halide photographic emulsion, exhibiting improvements in lowering in sensitivity and deterioration in image quality.

The foregoing object of the invention can be accomplished by the following constitution:

a silver halide emulsion comprising silver halide grains, wherein at least 50% of total grain projected area is accounted for by tabular grains having dislocation lines in the fringe portion, the tabular grains each comprising an internal region and a shell (V1);

the internal region comprising a silver halide phase (V3) having a maximum average iodide content, a silver halide phase (V6) located inside the silver halide phase (V3) and having an average iodide content of A6 mol %, and a silver halide phase (V7) located outside the silver halide phase (V3) and having an average iodide content of A7 mol %, and the following requirement being met:

$$0 \leqq A6/A7 \leqq 1.0;$$

the shell (V1) accounting for 10 to 50% by volume of the grain and having an average iodide content of 4 to 20 mol %, the shell (V1) comprising one or more sub-shells including an outermost sub-shell (V2), the outermost sub-shell (V2) accounting for 1 to 15% by volume of the grain and having an average iodide content of 0 to 3 mol %; and a silver halide color photographic light-sensitive material comprising a support having thereon a blue-sensitive layer, a green-sensitive layer and a red-sensitive layer, wherein the following requirement is met with respect to at least one of the yellow density, magenta density and cyan density:

$$10 \leqq PG/S \leqq 75$$

wherein PG represents an RMS granularity in a minimum density area and S represents a substantial fog.

DETAILED DESCRIPTION OF THE INVENTION

One aspect of the invention concerns a silver halide color photographic material comprising on a support a blue-sensitive layer, a green-sensitive layer and a red-sensitive layer, wherein the following requirement is satisfied in at least one of yellow, magenta and cyan densities:

$$10 \leqq PG/S \leqq 75$$

where "PG" represents a RMS granularity in the minimum density area and "P" represents a substantial fog.

With respect to at least one of the yellow, magenta and cyan densities is preferably $10 \leqq PG/S \leqq 65$, and more preferably $10 \leqq PG/S \leqq 50$. With respect to at least one of the magenta and cyan densities is preferably $10 \leqq PG/S < 75$, and with respect to magenta density is preferably $10 \leqq PG/S \leqq 75$.

The minimum density area refers to an unexposed area of a silver halide color photographic material relating to the invention. The RMS granularity in the minimum density area (PG) and substantial fog (S) can be determined in the following manner. Thus, when a silver halide color photographic material is processed in C-41 Process (produced by Eastman Kodak Co.), described in British Journal of Photography Annual 1988, page 196–198, the RMS granularity in the minimum density area (PG) is determined from the following formula:

Formula (A)

$$PG = \log_{10}(RMS \times 0.55).$$

Measurement is carried out by scanning a sample with a micro densitometer at a scanning aperture area of 750 $\mu m^2$ (a slit width of 5 $\mu$m and a slit length of 150 $\mu$m). A standard deviation of variation in density for the densitometry sampling number of at least 1000 is multiplied by 1000 and equally averaged out for each luminance. The thus obtained value is defined as "RMS", which is introduced in the above-described equation. In the measurement, Wratten filter W-99 (available from Eastman Kodak Co.) is used.

Corresponding to light-sensitivity of a silver halide light-sensitive layer to be measured, for example, in the case of being blue-sensitive, green-sensitive and red-sensitive, the measurement is conducted using a blue separation filter (Wratten filter W98, available from Eastman Kodak Co.), a green separation filter (Wratten filter W99) and a red separation filter (Wratten filter W26), respectively, to determine PGb, PGg and PGr as the RMS granularity in the yellow, magenta and cyan minimum density areas.

With regard to the minimum density area, density (a) is determined when processed with the foregoing process, C-41. Similarly, density (b) is determined, provided that a color developing agent is removed from the color developer solution and the pH is adjusted to the same as the developer of C-41 using potassium hydroxide. Corresponding to light sensitivity (i.e., blue-, green- and red-sensitivity) of respective silver halide emulsion layers, the difference between densities (a) and (b) [i.e., density (a) minus density (b)] is measured through the foregoing blue-, green- and red-separation filters with a densitometer (produced by X-rite Corp.) to determine Sb, Sg and Sr as substantial fog.

One preferred embodiment of the invention is $10 \leqq \{(PGg/Sg)+(PGr/Sr)\}/2 \leqq 80$. In this case, $10 \leqq \{(PGg/Sg)+(PGr/Sr)\}/2 \leqq 70$ is more preferred and $10 < \{(PGg/Sg)+(PGr/Sr)\}/2 \leqq 60$ is still more preferred. One preferred embodiment of the invention is $10 \leqq \{(PGb/Sb)+(PGg/Sg)+(PGr/Sr)\}/3 \leqq 100$. In this case, $10 \leqq \{(PGb/Sb)+(PGg/Sg)+(PBr/Sr)\}/3 \leqq 90$ is more preferred and $10 \leqq \{(PGb/Sb)+(PGg/Sg)+(PGr/Sr)\}/3 \leqq 80$ is still more preferred.

The silver halide color photographic material of the invention preferably comprises at least a light-sensitive silver halide emulsion layer meeting the following requirement:

$$0.1 \leqq D1/D2 \leqq 0.8$$

where D1 represents a mean size of developed silver in the minimum density area and D2 represents a mean size of developed silver at a density point of a color density of Dmin (i.e., minimum density) plus 0.15. In this case, $0.1 \leqq D1/D2 \leqq 0.7$ is more preferred and $0.1 \leqq D1/D2 \leqq 0.6$ is still more preferred. In the invention, the light-sensitive silver halide emulsion layer satisfying $0.1 \leqq D1/D2 \leqq 0.8$ is preferably a green-sensitive layer or red-sensitive layer, and more preferably a green-sensitive layer. In cases where the silver halide color photographic material comprises plural silver halide emulsion layers having the same color-sensitivity and different in speed, the layer meeting the foregoing requirement is preferably a higher-speed silver halide emulsion layer, and more preferably a highest-speed silver halide emulsion layer.

The density point of a color density of Dmin plus 0.15 refers to a density point exhibiting a color density of Dmin plus 0.15 on a density exposure characteristic curve of the silver halide photographic material, which can be determined by subjecting a photographic material to exposure through an optical stepped wedge to a light source of a color temperature of 5400° K and the foregoing processing in C-41 of Eastman Kodak Co. and then densitometry through blue-, green- and red-separation filters using a densitometer of X-rite Corp. In this case, the photographic material is maintained at a temperature of 20–5° C. and a relative humidity of 60±10% over the period of from exposure to processing, and the processing after exposure is completed within 30 min to 6 hrs.

The mean developed silver size, D1 and D2 can be determined in the following manner. A photographic material sample is exposed through a stepped wedge in the same manner as in the foregoing determination of the density point of a color density of Dmin plus 0.15, then, subjected to the processing for evaluation of developed silver, described below and dried. The minimum density area and the area subjected to exposure giving a color density of Dmin plus 0.15 of the processed sample are each observed with a microscope fitted with an object lens immersed in oil. At least 5,000 of developed silver are photographed at random at a resolution of more than 0.1 μm/pixel. The obtained micrographs are subjected to image processing to determine the projected area of each developed silver. The developed silver grain size (hereinafter, also denoted as developed silver size) is calculated as a diameter of a circle having an area equivalent to the projected area (i.e., equivalent circular diameter). The mean value of the developed silver sizes is determined with respect to the minimum density area and the area subjected to exposure giving a color density of Dmin plus 0.15. Thus, the mean developed silver size in the minimum density area is denoted as D1 and the mean developed silver size in the area at a color density of Dmin plus 0.15 is denoted as D2.

Processing for Developed Silver Evaluation

Processing is conducted according to the following steps:

| | | |
|---|---|---|
| Color developing | 3 min. 15 sec | 38 ± 0.1° C. |
| Stop | 3 min. | 24.0 ± 5.0° C. |
| Washing | 5 min. | 24 to 41° C. |
| Fixing | 10 min. | 38.0 ± 3.0° C. |
| Washing | 3 min. 15 sec. | 24 to 41° C. |
| Drying | not more than 50° C. | |

Compositions of processing solutions used in respective steps are as follows.

Color Developing Solution

| | |
|---|---|
| 1-Amino-3-methyl-N-ethyl-N-(β-hydroxyethyyl)aniline sulfate | 4.75 g |
| Sodium sulfite anhydride | 1.25 g |
| Hydroxylamine ½ sulfate | 2.0 g |
| Potassium carbonate anhydride | 37.5 g |
| Sodium bromide | 1.3 g |
| Trisodium nitrilotriacetate (monohydrate) | 2.5 g |
| Potassium hydroxide | 1.0 g |
| Water to make 1 lit. (pH = 10.1) | |
| Stop solution | |
| Acetic acid (56%) | 52.6 ml |
| Water to make 1 lit. | |
| Fixing solution | |
| Ammonium thiosulfate | 175.0 g |
| Sodium sulfite anhydride | 8.5 g |
| Sodium metasulfite | 2.3 g |
| Water to make 1 lit. | |
| The pH is adjusted to 6.0 with acetic acid. | |

The silver halide photographic material relating to the invention comprises at least a silver halide emulsion layer containing tabular silver halide grains. The tabular silver halide grains used in the invention are those having an aspect ratio of not less than 2. The aspect ratio of the tabular silver halide grains is preferably 3 to 100, more preferably 5 to 100, and still more preferably 3 to 100. The average aspect ratio of the tabular silver halide grains can be adjusted to the above-described range according to the preparation method known in the photographic art. The average aspect ratio of tabular silver halide grains can be determined in such a manner that silver halide grains are each measured with resect to grain diameter and thickness to determine the aspect ratio for each grain according to the following formula and the obtained values are averaged for at least 300 grains to determine the average aspect ratio:

$$\text{Aspect ration} = \text{grain diameter}/\text{grain thickness}.$$

In the silver halide photographic material relating to the invention, at least a silver halide emulsion preferably contains tabular silver halide grains having an average grain thickness of less than 0.07 mm. Tabular silver halide grains having an average aspect ratio of not less than 0.01 μm and less than 0.07 μm are called ultra-thin tabular grains. The tabular silver halide grain emulsion having an average aspect ratio of less than 0.07 μm refers to a silver halide emulsion in which an least 50% of the total projected area of silver halide grains is accounted for by tabular silver halide grains and the average aspect ratio of the tabular grains is 0.07 μm. The tabular silver halide grains preferably account for at least 70% of the total grain projected area. The average grain thickness of the tabular silver halide grains is preferably not less than 0.01 μm and less than 0.06 μm. The ultra-thin tabular grains can be prepared in accordance with the method described in U.S. Pat. No. 5,250,403 or European Patent No. 0,362,699A3.

Silver halide photographic materials relating to the invention can be prepared preferably using the silver halide emulsion according to the invention, as described below. Thus, the silver halide emulsion comprises silver halide grains, in which at least 50% of the projected area of total silver halide grains is accounted for by tabular grains having dislocation lines in the fringe portion of the grain, the tabular grains comprising a silver halide phase (V3) having a maximum iodide content, a silver halide phase (V6) located inside of the silver halide phase (V3)) and having an average iodide content of A6 mol %, and a silver halide phase (V7) located outside of the silver halide phase (V3)) and having an average iodide content of A7 mol %, and meeting following requirement:

$$0 \leqq A6/A7 \leqq 1.0;$$

wherein A6 and A7 are an average iodide contents (expressed in mol %) of the silver halide phase (V6) and silver halide phase (V7), respectively. The tabular grains each further comprise a shell (V1), which is located outside the silver halide phase (V3), in a region forming dislocation lines and accounts for 10 to 50% of grain volume, having an average iodide content of 4 to 20 mol %. The shell (V1) comprises one or more sub-shells differing in halide composition and including an outermost sub-shell (V2). The outermost sub-shell (V2) accounts for 1 to 15% of grain volume and having an average iodide content of 0 to 3 mol %.

In the invention, the fringe portion of the tabular silver halide grains is defined as follows. In the projection image projected vertical to the major face of the tabular grains, when a line is drawn parallel to the edge of the major face and at a distance from the edge of 1/20 of the equivalent circular diameter of the tabular grain, the fringe portion refers to the region surrounded by the edge and the line, except for a region near the corners of the major face.

In the tabular silver halide grain emulsion relating to the invention, the tabular silver halide grains having dislocation lines in the fringe portion preferably account for at least 60%, and more preferably at least 80% of the total projected area of silver halide grains. In this case, the dislocation lines may further be located at any portion, such as corners of the major face, other than the fringe portion.

The dislocation lines are preferably introduced at a position of not less than 50%, and more preferably not less than 60% and less than 85% of total silver of silver halide grains. The number of dislocation lines is preferably not less than 10 lines, more preferably not less than 20 lines, and still more preferably not less than 30 lines per grain. The grain volume refers to the volume of a final grain, i.e., the volume of the grain at the time when growth of silver halide grains contained in the silver halide emulsion is completed.

In cases when a silver halide phase is formed by the double jet addition of an aqueous silver nitrate solution and an aqueous iodide-containing halide solution, the average iodide content of the silver halide phase is represented by the percentage (mol %) of iodide ions contained in the halide solution, based on silver ions contained in the silver nitrate solution. The volume of the formed silver halide phase is the volume of silver halide newly formed by silver ion contained in the added silver nitrate solution. In cases when a silver halide phase is formed by addition of fine silver iodide-containing halide grains, the average iodide content of the formed silver halide phase is represented by the average iodide content (mol %) of the fine silver halide grains and the volume of the formed silver halide phase is equal to the total volume of the added fine grains.

In cases when an iodide-containing halide solution is singly added or in cases when an iodide ion-releasing compound is added to allow iodide ions to be released from the compound, halide conversion is assumed to occur to an extend of 100% on the surfaces of silver halide grains formed immediately before addition of the halide solution of the iodide ion-releasing compound, by iodide ions contained in the halide solution or iodide ions released from the compound and the average iodide content of the formed silver halide phase is therefore supposed to be 100 mol %. the volume of the formed silver halide phase is supposed to be equal to the volume of silver iodide formed by iodide ions of the halide solution or iodide ions released from the iodide ion-releasing compound. In this case, formation of the silver halide phase includes the surface of silver halide grains which was formed immediately before addition of the halide solution or iodide ion-releasing compound and occurs in a silver halide phase accounting for a volume equivalent to the volume of silver iodide formed inside the said grain surface.

The shell (V1) located in the region forming dislocation lines is a silver halide phase formed through grain growth over a period of from the time dislocation lines are introduced to the time formation of silver halide grains is completed, thereby forming a shell over the internal silver halide region. The shell (V1) preferably accounts for 15 to 50%, and more preferably 20 to 50% of the grain volume. The average iodide content (A1) of the shell (V1) is preferably 5 to 17 mol % and more preferably 6 to 15 mol %.

The outermost sub-shell (V2) is a silver phase included in the shell (V1) and located in the outermost portion of the shell (V1). The outermost sub-shell (V2) preferably accounts for 2 to 12%, and more preferably 3 to 10% of the grain volume. The average iodide content of the outermost sub-shell (V2) is preferably 0 to 2 mol %, and more preferably 0 to 1 mol %. In the invention, the interior of the grain is a silver halide phase, except for the outermost surface layer of the silver halide grain, as described later.

The silver halide phase (V3) has a maximum average iodide content A3 (expressed in mol %). Thus, the average iodide content of the silver halide phase (V3), A3 is the largest within the grain, and A3 is preferably not less than 20 mol %, more preferably $20<A3<100$ mol %, and still more preferably $40 \leqq A3 \leqq 100$ mol %. The silver halide phase (V3) is preferably located external to 60% of the grain volume and internal to 80% of the grain volume, i.e., the silver halide phase (V6) is located within the intermediate region between at 60 and 80% of the final grain volume.

As described above, the ratio of A6/A7 is preferably $0 \leqq A6/A7 \leqq 1.0$, more preferably $0 \leqq A6/A7 \leqq 0.7$, and still more preferably $0 \leqq A6/A7 \leqq 0.5$. The A6 is preferably 0 to 12 mol %, and more preferably 0 to 8 mole %. A7 is preferably 3 to 20 mol %, and more preferably 5 to 15 mol %. The silver halide phase (V6) located inside of the silver halide phase (V3) is an entire silver halide phase formed before formation of the silver halide phase (V3) and the silver halide phase (V7) located outside of the silver halide phase (V3) is an entire silver halide phase formed after formation of the silver halide phase (V3).

In the silver halide emulsion of the invention, the average iodide content of the outermost surface layer of silver halide grains is I3 (mol %) in the major face portion and I4 (mol %) in the side face portion, at least 50% by number of the tabular grains preferably meet the following requirement, I3>I4. The iodide content of the outermost surface layer in the major face portion, or in the side face portion can be determined in accordance with the following procedure. Tabular silver halide grains are taken out of a silver halide emulsion through gelatin degradation with proteinase, enclosed with methacrylic resin and then continuously sliced at a thickness of ca. 50 $\mu$m, using a diamond cutter. From observation of a slice exhibiting the intersection vertical to two parallel major faces of the tabular grain, a silver halide phase parallel to the major face and to a depth of 5 $\mu$m from the surface is denoted as the major face portion and among the outermost surface layer, the portion other than the major face portion is denoted as a side face portion. The iodide content of the major face and side face portions is determined through spot analysis by the commonly known EPMA method at a spot diameter of not more than 5 $\mu$m, and preferably not more than 2 $\mu$m. The major face portion and the side face portion each measured at regular distance intervals of at least 10 and the average value thereof is used as I3 or I4 of the tabular silver halide grains. The relationship between I3 and I4 is preferably $1.3<I3/I4<100$, more preferably $2.0<I3/I4<50$, and still more preferably $2.5<I3/I4<40$. I3 is preferably less than 30 mol %, and more preferably less than 20 mol %.

In one embodiment of the preparation of silver halide emulsion relating to the invention, at first, a low iodide silver halide phase is allowed to preferentially grow laterally in the direction toward the side face of the tabular silver halide grain, thereafter, a high iodide silver halide phase is allowed to preferentially grow vertically in the direction toward the major faces. To the contrary, at first, a high iodide silver halide phase is allowed to preferentially grow vertically in the direction toward the major faces of the tabular silver halide grain, thereafter, a low iodide silver halide phase is allowed to preferentially grow laterally in the direction toward the side face. Combining various methods and conditions, an ultra-thin silver halide layer can be formed while precisely controlling its composition. To allow tabular silver halide grains to preferentially grow in the direction toward the side face or major face, selections of concentrations of added solutions containing silver ions, halide ions or fine silver halide grains capable of supplying silver and halide ions through dissolution during grain growth, the growing temperature, pBr, pH and gelatin concentration are of importance. Control is feasible to some extent by the combination of the foregoing factors or by the combination of grain shape, halide composition, the ratio of (100) face/(111) face, and the like. To perform preferential growth toward the side face, for example, the pBr and gelatin concentration are preferably 1.0 to 2.5 and 0.5 to 2.0%, respectively. To form tabular silver halide grains exhibiting a relatively high aspect ratio, a pH of 2.0 to 5.0 is preferred and a pBr of 2.5 to 4.5 is preferred to perform preferential growth in the direction toward the major faces.

A method of supplying fine silver halide grains to supply silver and halide ions through dissolution of the fine grains is suitable for precisely and uniformly controlling the thickness and halide composition of the outermost surface layer of silver halide crystals, rather than an ion-supplying method. The fine silver halide grains can be prepared in accordance with the method to be described later. The fine silver halide grains preferably are those which have been subjected to desalting by washing by use of coagulants, or membrane separation to remove unwanted substances such as salts or ions, and are specifically preferred those which have been subjected to membrane separation to remove unwanted substances, without using coagulants. When different silver halide phases in halide composition are formed in the direction toward the major face and/or side face, removal of unwanted substances such as salts or ions by washing desalinization or membrane separation is optimally applied, whereby after one of the silver halide phases is formed, remaining excessive or unwanted halide ions are removed to prevent occurrence of unintended halide conversion in the subsequent process, making it easier to control halide composition in the process of forming the other silver halide phase. Such removal of unwanted substances such as salts or ions by washing or membrane separation is preferably conducted after forming substrate grains, after growing a silver halide phase in any one of the directions toward the major face and/or side face, or after forming any of silver halide phases. It is preferably conducted every time when each of the silver halide forming processes is completed. The method to be described later may be applied to the removal of unwanted substances such as salts or ions by washing or membrane separation, and it is specifically preferred to remove unwanted substances such as salts or ions by membrane separation, without using coagulants.

In one embodiment of the preparation of silver halide emulsions relating to the invention, besides controlling the condition of silver halide grain growth, it is preferred to use additives such as so-called silver halide growth-controlling agents or crystal habit-controlling agents to control growth or tabular silver halide grains in the direction toward the major face or side face. For example, after growing low iodide surface phase in the direction toward the side face of tabular silver halide grains, polyalkyleneoxide or its related compounds used for enhancing homogeneity of tabular silver halide grain size, described in U.S. Pat. Nos. 5,147,771, 5,147,772, and 5,147,773 and JP-A No. 6–308644 may be added to restrain the growth in the side face direction to make it easier to grow a high iodide surface phase in the major face direction, thereby promoting the formation of tabular silver halide grains relating to he invention.

A technique of halide conversion by adding a halide salt alone, such as an iodide salt or a technique of epitaxial junctions described in JP-A Nos. 58-108526 and 59-133540 and 59-162540 may also be applied in the separate formation of silver halide phases different in halide composition in the major face direction and/or side face direction. It is also preferred that employing the difference in crystal face between the major face and side face in the separate formation of silver halide phases different in halide composition in major face direction and/or side face direction, adsorbing material such as a dye or inhibitor exhibiting face-selective adsorptive property is allowed to be adsorbed on a specific surface of silver halide grains and a silver halide phase having any halide composition is grown in the non-adsorbed face by the foregoing or that to be described later.

The foregoing separate formation of silver halide phases differing in halide composition in the major face direction and/or side face direction can be conducted at any one or plural stages of nucleation, growth, physical ripening, desalting, spectral sensitization and chemical sensitization, preferably at the stage after completing at least 90% of grain formation, based on total silver, and more preferably after forming tabular silver halide substrate grains and before completing spectral sensitization or chemical sensitization. In one embodiment of the invention, it is preferred to use a compound having a group promoting adsorption onto silver halide and a substituent group capable of releasing a halide ion, as described in Japanese Patent Application No. 11-95347.

The average size of silver halide grains used in the invention is preferably 0.2 to 10.0 μm, more preferably 0.3 to 7.0 μm, and still more preferably 0.4 to 5.0 μm. The average size is an arithmetic mean of grain size $r_1$, to the third significant figure, with the final figure rounded and at least 1,000 grains selected at random are measured. The grain size, $r_1$ is a diameter of a circle having an area equivalent to the projected area vertical to the major face in the case of a tabular grain and in the case of a silver halide grain having a shape other than the tabular grain, it is a diameter of a circle having an area equivalent to its projected area. The grain size ($r_i$) can be determined by measuring the grain diameter or projection area in 10,000 to 17,000 power electron micrographs of silver halide grains.

To determine the grain diameter or aspect ratio of silver halide grains, the projected area or thickness for each grain can be determined in accordance with the following procedure. A sample is prepared by coating a tabular grain emulsion containing a latex ball having a known diameter as an internal standard on a support so that the major faces are arranged in parallel to the support surface. After being subjected to shadowing by carbon vapor evaporation, replica sample is prepared in any of the conventional replica methods. From electron micrographs of the sample, a diameter of a circle equivalent to the grain projected area and grain thickness are determined using an image processing apparatus. In this case, the grain projected area can be determined from the internal standard and the projection area and the grain thickness can be determined from the internal standard and silver halide grain shadow.

Any silver halide emulsion, such as a polydisperse emulsion having a relative wide grain size distribution or a monodisperse emulsion of a relatively narrow grain size distribution can used in the invention and a monodisperse emulsion is preferred. The monodisperse emulsion is one having a grain size distribution, as defined below, of less than 20%, and preferably less than 16%;

Grain size distribution (%)=(standard deviation of grain size/average grain size)×100 wherein the average grain size and standard deviation can be determined from the grain size, $r_1$ defined above.

Silver halide emulsions used in the invention may be any silver halide, including silver iodobromide, silver iodochlorobromide and silver iodochloride. Of these are preferred silver iodobromide and silver iodochlorobromide. The average iodide content of silver halide grains contained in the silver halide emulsion is preferably 0.5 to 40 mol %, and more preferably 1 to 20 mol %. The average iodide content can be determined by the EPMA method (Electron Probe Micro Analyzer method).

Silver halide grains contained in the silver halide emulsion relating to the invention are preferably core/shell type grains. The core/shell type grains are those which are comprised of a core and a shell covering the core, in which the shell comprises on e or more layers. The iodide contents of the core and shell preferably are different from each other.

The dislocation lines in tabular grains can be directly observed by means of transmission electron microscopy at a low temperature, for example, in accordance with methods described in J. F. Hamilton, Phot. Sci. Eng. 11 (1967) 57 and T. Shiozawa, Journal of the Society of Photographic Science and Technology of Japan, 35 (1972) 213. The method for introducing dislocation lines into the tabular grains is not specifically limited and examples thereof include double-jet addition of an aqueous iodide ion containing solution (such as an aqueous potassium iodide solution) and aqueous silver salt solution, addition of fine silver iodide grains, addition of an aqueous iodide ion containing solution alone, and the use of an iodide ion releasing agent described in JP-A 6-11781 and JP-A 11-271912. Applying the foregoing commonly known methods, dislocation as an origin of dislocation lines can be formed at the intended position.

In the preparation of silver halide emulsion relating to the invention, various methods are applicable to the formation of silver halide grains. Thus, single jet addition, double jet addition, triple jet addition or fine silver halide grain-supplying method is usable singly or in combination. A technique of controlling the pH and pAq in a liquid phase forming silver halide along with the grain growth rate may be applied in combination. The grain formation is preferably carried out under the condition close to critical grain growth rate.

A seed grain emulsion may be used in the preparation of silver halide emulsions relating to the invention. Silver halide grains contained in the seed emulsion may be those having a regular crystal structure, such as cubic, octahedral or tetradecahedral grains or those having an irregular crystal structure such as spherical or tabular grains. These grains may have any proportion of (100) face and (111) face. The seed grains may be composite of these crystal forms or a mixture of various crystal forms grains. Specifically, silver halide grains contained in the seed emulsion preferably are twinned crystal grains, and more preferably twinned crystal grains having two parallel twin planes.

In any case of using the seed emulsion or using no seed emulsion, commonly known methods are applicable as conditions for nucleation and ripening of silver halide grains. Silver halide solvents known in the art may be used in the preparation of silver halide emulsions but it is preferred to avoid the use of such silver halide solvents in the formation of tabular substrate grains, except for at ripening after nucleation.

Any of the acidic precipitation process, neutral precipitation process or ammoniacal precipitation process is applicable to the preparation of silver halide emulsions relating to the invention, and the acidic or neutral precipitation process is preferred. Halide and silver ions may be simultaneously mixed or either one of them may be added into the other one. Taking account of critical growth rate of silver halide crystals, halide and silver ions may be sequentially or simultaneously added, while controlling the pAg and pH within the vessel. Halide conversion may be applied at any stage in the silver halide to vary halide composition.

In the nucleation process and/or the growth process of silver halide grains, a metal ion may be incorporated using at least a metal ion selected from a cadmium salt, zinc salt, lead salt, thallium salt, iridium salt (including its complex salt), rhodium salt) including its complex salt), and salts of iron and Group VIII metals (including their complex salts) and the metal ion can be occluded in the interior and/or exterior (or surface) of the grain.

In cases where fine silver halide grains are used in the invention, the fine silver halide grains may be prepared in advance to or concurrently to the preparation of silver halide grains relating to the invention. In the latter concurrent preparation, as described in JP-A 1-183417 and 2-44335, the fine silver halide grains can be prepared using a mixer separately provided outside the reaction vessel for preparing the silver halide grains relating to the invention. It is preferred that a preparation vessel is separately provided from the mixer and fine silver halide grains which have been prepared in the mixer are optimally prepared in the preparation vessel so as to fit the growth environment within the reaction vessel for preparing the silver halide grains relating to the invention, thereafter, the fine silver halide grains are supplied to the reaction vessel. In cases when reduction-sensitized fine grains are not intended, the fine grains are preferably prepared in an acidic or neutral environment (at a pH <9). In cases when intending the reduction-sensitive fine grains, the fine grains can be prepared by combining means for reduction sensitization. The fine silver halide grains can be prepared by mixing an aqueous silver ion solution and aqueous halide ion solution while optimally controlling super-saturation factors. Control of super-saturation factors can be carried out with reference to the teaching of JP-A 63-92942and 63-311244.

Silver halide emulsions relating to the invention preferably contain at least one of polyvalent metallic atoms, polyvalent metallic atom ions, polyvalent metallic atom complex and polyvalent metallic atom complex ions. The silver halide emulsions are preferably subjected to reduction sensitization. The kind and use of polyvalent metallic atoms, polyvalent metallic atom ions, polyvalent metallic atom complex and polyvalent metallic atom complex ions and the reduction sensitization are referred to the teaching of Japanese Patent Application No. 11-251651.

On one preferred embodiment of the invention, the solver halide emulsion is chemically sensitized with selenium compounds or a tellurium compounds at a silver potential of 30 to 70 mV and a pH of 6.0 to 7.0, and further using a compound represented by the following formula (1):

$$R1-(S)m-R21) \quad (1)$$

wherein R1 and R2 each represent an aliphatic group, aromatic group, heterocyclic group or an atomic group capable of forming a ring by the combination with each other, provided that when R1 and R2 are aliphatic groups, R1 and R2 may combine with each other to form a ring; m is an integer of 2 to 6.

Selenium compounds usable in the invention preferably are labile selenium compounds capable of forming silver selenide precipitate upon reaction with silver nitrate in aqueous solution, as described in U.S. Pat. Nos. 1,574,944, 1,602,592 1,623,499; JP-A No. 60-150046, 4-25832, 4-109240 and 4-147250. Examples of useful selenium compounds include colloidal selenium, isocyanoselenates (e.g. allylisoselenate), selenoureas (e.g., N,N-dimethylselenourea, N,N,N'-triethylselenourea, N,N,N'-trimethyl-N'-heptafluoroselenourea, N,N,N'-trimethyl-N'-heptafluoropropylcarbonylselenourea, N,N,N'-trimethyl-N'-1-nitrophenylcarbonylselenourea, etc.), selenoketones (e.g., selenoacetone, selenoacetophenone), selenosmides (e.g., selenoacetoamide, N,N-dimethylselenobenzamide), selenocarboxylic acids and selenoesters (e.g., 2-selenopropionic acid, methyl-3-selenobutyrate), selenophosphates (e.g., tri-p-triselenophosphate), and selenides (e.g., dimethyl selenide, triphenylphsphine selenide, pentafluorophenyldiphenylphosphine selenide, triphenylphosphine selenide, tripyridylphosphine selenide). Of these compounds are preferred selenoureas, selenoamides and selenides. Technique for using these selenium compounds are exemplarily described in the following patents: U.S. Pat. Nos. 1,574,944, 1,602,592, 1,6223,499, 3,297,466, 3,297,447, 3,320,069, 3,408,196, 3,408,197, 3,442,653, 3,420,670, 3,519,385; French Patent No. 2,693,038, 2,093,209; JP-B No. 52-34491, 52-34492, 53-295, 57-2090 (hereinafter, the term, JP-B means a published Japanese Patent); JP-A 59-180536, 59-185330, 59-181337, 59-187338, 59-192241, 60-150046, 60-151637, 61-246738, 3-4221, 3-24537, 3-111838, 3-116132, 3-18648, 3-237450, 4-16838, 4-25832, 4-32831, 4-06059, 4-109240, 4-140738, 4-140739, 4-147250, 4-184331, 4-190225, 4-191729, 4-195035; British Patent No. 255,846, and 861,984. H. E. Spencer et al. Journal Photographic Science vol. 31 pages 158–169 (1983) also discloses the selenium sensitization.

Next, tellurium sensitizers are described. Thus, exemplary examples of preferred compounds are shown below, but are not limited to these.

Te-1

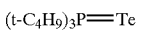

Te-2

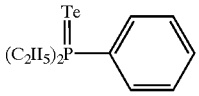

Te-3

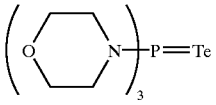

These selenium sensitizers and tellurium sensitizers are dissolved in water or an organic solvent such as methanol or ethanol, or a mixture thereof and added at the stage of chemical sensitization (preferably immediately before starting chemical sensitization), in the form described in JP-A 4-140738, 4-140742, 5-11381, 5-11385 and 5-11388, preferably in the form of a solid in water type suspension. The selenium or tellurium sensitizer is used alone or in combination of two or more sensitizers. A labile selenium compound and non-labile selenium compound may be used in combination. Alternatively, at least a selenium sensitizer and at least a tellurium sensitizer may be used in combination. The amount of a selenium or tellurium sensitizer to be added, depending on activity of the sensitizer, the kind or grain size of silver halide, and ripening temperature or time, is preferably not less than $1\times10^{-8}$ mol, and more preferably $1\times10^{-7}$ to $1\times10^{-5}$ mol per mol of silver halide.

A sulfur sensitizer is preferably used in combination in the invention. Examples of preferred sulfur sensitizers include thioureas such as 1,3-diphenylthiourea, triethylthiourea, and 1-ethyl-3-(2-thiazolyl)thiourea; rhodanine derivatives, dithiocarbamates, polysulfide organic compounds, thiosulfates and sulfur simple substance. Sulfur simple substance is preferably rhombic α-sulfur. There are also usable other sulfur sensitizers described U.S. Pat. Nos. 1,574,944, 2,410,689, 2,278,947, 2,728,668, 3,501,313, and 3,656,955,; West German Patent (OLS) No. 1,422,869; JP-A 56-24937 and 55-45016.

Noble metal salts such as gold, platinum, palladium and iridium are preferable used as a sensitizer, as described in Research Disclosure (hereinafter, also denoted as RD) vol. 305, item 308105. Specifically, the combined use of a gold sensitizer is preferred. Preferred examples of the gold sensitizer include chloroauric acid, gold thiosulfate, gold thiocyanate and organic gold compounds described in U.S. Pat. Nos. 2,597,856 and 5,049,485; JP-B No. 44-15748; JP-A No. 1-147537 and 4-70650. Further, in the case of sensitization using a gold complex salt, thiosulfates, thiocyanates or thioethers are preferably used as an auxiliary agent, and the use of a thiocyanate is specifically preferred.

The amount of a sulfur or gold sensitizer to be used, depending on the kind of silver halide, the kind of the compound and ripening conditions, is preferably $1\times10^{-9}$ to $1\times10^{5}$, and more preferably $1\times10^{-9}$ to $1\times10^{-4}$ mol per mol of silver halide. The foregoing sensitizers are added, depending on properties of the sensitizers. Thus, the sensitizers may be added through solution in water or organic solvents such as methanol, or mixedly added with gelatin solution. Alternatively, the sensitizers may be added in the form of an emulsified dispersion of a mixture solution with an organic solvent-soluble polymer, as described in JP-A 4-140739.

The combined use of a reduction sensitizer is feasible and reducing compounds described RD 307, item 307105 and JP-A 7-78685 are usable. Examples thereof include aminoiminomethanesulfinic acid (or thiourea dioxide), borane compounds (e.g. dimethylamine-borane), hydrazine compounds (e.g., hydrazine, p-tolylhydrazine), stannous chloride, silane compoundsreductones (e.g., ascorbic acid), sodium sulfite, aldehyde compounds and hydrogen gas. Reduction sensitization may be carried out in an atmosphere at a relatively high pH or in excess of silver ions, as described in Japanese Patent Application No. 8-277938, 8-251486 and 8-182035.

In one of preferred embodiments of the invention, a silver halide emulsion is chemically sensitization at a silver potential of 30 to 70 mV and a pH of 6.0 to 7.0 together with a selenium or tellurium compound and a compound represented by the following formula (1) described earlier. The silver potential of the silver halide emulsion indicates a silver potential before subjected to spectral sensitization and chemical sensitization and can be determined by measuring an emulsion maintained at 40° C. using a silver ion selection electrode and a reference electrode of saturated silver—silver chloride. The silver potential of the emulsion is 40 to 70 mV, and preferably 40 to 60 mV. In this case, chemical sensitization carried out at a pH of 6.0 to 7.5, preferably 6.0 to 7.0, and more preferably 6.3 to 7.0.

Further in this case, the compound of formula (1) is contained. In the formula, an aliphatic group represented by R1 and R2 include a straight chain or branched alkyl group having 1 to 30 carbon atoms (and preferably 1 to 20 carbon atoms), alkenyl group, alkynyl group and cycloalkyl group, such as methyl, ethyl, propyl, butyl, hexyl, decyl, dodecyl, isopropyl, t-butyl, 2-ethylhexyl, allyl, 2-butenyl, 7-octenyl, propargyl, 2-butynyl, cyclopropyl, cyclopentyl, cyclohexyl, and cyclododecyl, An aromatic group represented by R1 and R2 include one having 6 to 20 carbon atoms, such as phenyl, naphthyl and anthranyl. A heterocyclic group represented by R1 and R2 may be monocyclic or a condensed ring, including 5- or 6-membered heterocyclic group containing at least one of O, S and N atoms and an amine-oxide group. Examples thereof include pyrrolidine, piperidine, tetrahydrofuran, tetrahydropyran, oxirane, morpholine, thiomorpholine, thiopyrane, tetrahydrothiophene, pyrrole, pyridine, furan, thiophene, imidazole, pyrazolo, oxazole, thiazole, isooxazole, isothiazole, riazole, tetrazole, thiadiazole, oxadiazole, and groups derived from their benzelogs. Rings formed by R1 and R2 include 4- to 7-membered rings and 5- to 7-membered rings are preferred. The group represented by R1 and R2 is preferably an aromatic group or a heterocyclic group, and more preferably a heterocyclic group. The aliphatic group, aromatic group or heterocyclic group represented by R1 and R2 may be substituted with a substituent group. Examples of such a substituent group include a halogen atom (e.g., chlorine atom, bromine atom), alkyl group (e.g., methyl ethyl, isopropyl, hydroxyethyl, methoxyethyl, trifluoromethyl, t-butyl), cycloalkyl group (e.g., cyclopentyl, cyclohexyl), aralkyl group (e.g., benzyl, 2-phenethyl), aryl group (e.g., phenyl, naphthyl, p-tolyl, p-chlorophenyl), alkoxy group (e.g., methoxy, ethoxy, isoproxy, butoxy), aryloxy group (e.g., phenoxy, 4-methoxyphenoxy), alkylthio group (e.g., methylthio, ethylthio, butylthio), arylthio group (e.g., phenylthio, p-methylphenylthio), sulfonylamino group (e.g., methanesulfonylamino, benzenesulfonylamino), ureido group (e.g., 3-methylureido, 3,3-dimethylureido, 1,3-dimetylureido), sulfamoylamino group (e.g., dimethylsulfamoylamino, diethylsulfamoylamino), carbamoyl group (e.g., methylcarbamoyl, ethylcarbamoyl, dimethylcarbamoyl), sulfamoyl group (e.g., ethylsufamoyl, dimethylsufamoyl), alkoxycarbonyl group (e.g., methoxycarbonyl, ethoxycarbonyl), aryloxycarbonyl group (e.g., phenoxycarbonyl, p-chlorophenoxycarbonyl), sulfonyl group (e.g., methanesulfonyl, butanesulfonyl, phenylsulfinyl), acyl group (e.g., acetyl, propanoyl, butyloyl), amino group (e.g., methylamino, ethylamino, dimethylamino), hydroxy group, nitro group, nitroso group, aminoxide group (e.g., pyridine-oxide), imido group (e.g., phthalimido), disulfide group (e.g., benzene-disulfide, benzothiazolyl-2-disulfide), and heterocyclic group (pyridyl, benzimidazolyl, benzthiazolyl, benzoxazolyl). Of these are specifically preferred groups having an electron-withdrawing group. R1 and R2 may contain one or more substituent groups described above. These substituent groups may be further substituted; and m is an interger of 2 to 6 and preferably 2 or 3.

Exemplary examples of the compound represented by formula (1) are shown below bur are not limited to these.

1-1

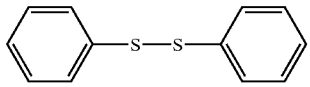

1-2

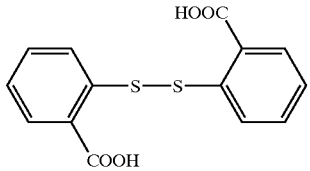

1-3

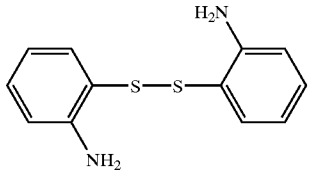

1-4

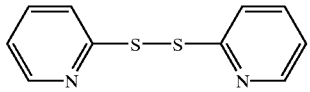

1-5

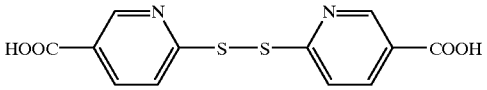

-continued
1-6
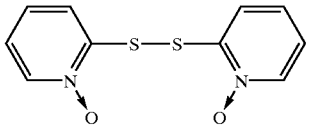
1-7
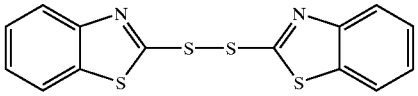
1-8
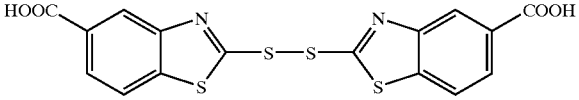
1-9
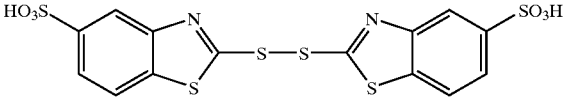
1-10
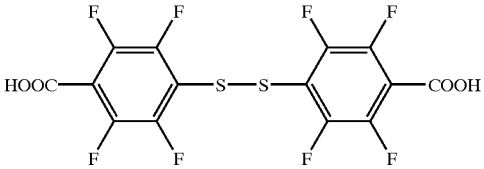
1-11
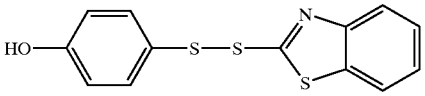
1-12
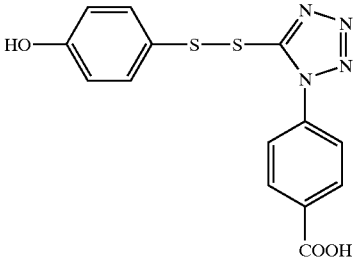
1-13
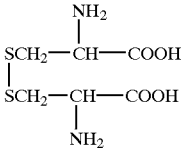
1-14
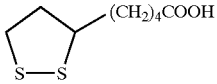
1-15
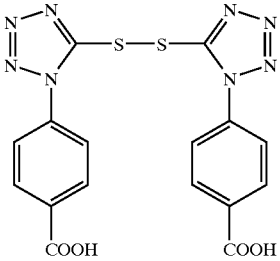
-continued
1-16
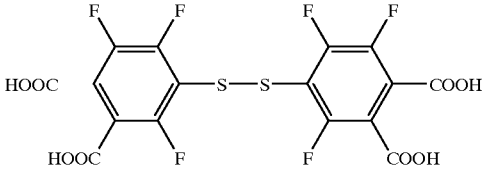
1-17
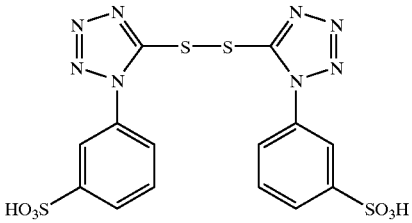
1-18
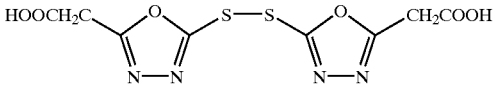
1-19
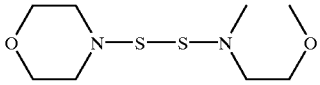
1-20
1-21
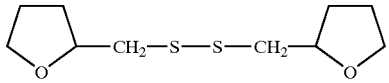
1-22
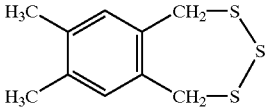
1-23
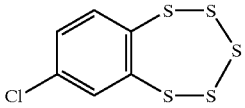
1-24
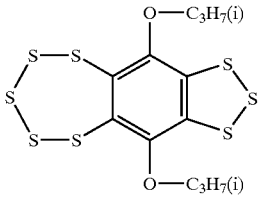
1-25
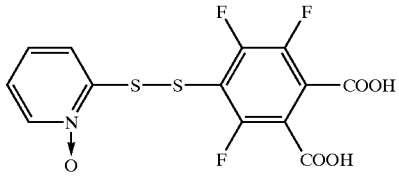
1-26
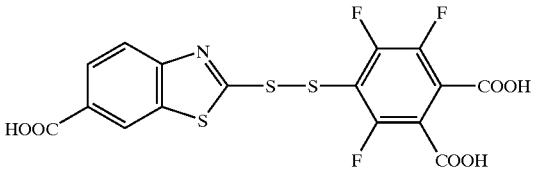

-continued 1-27

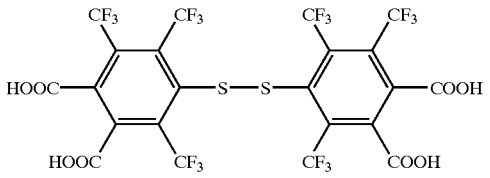

1-28

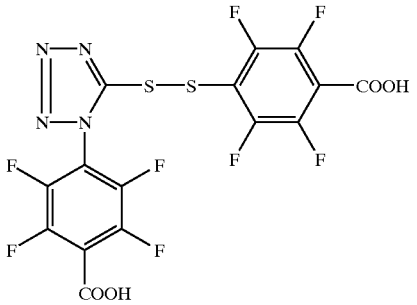

1-29

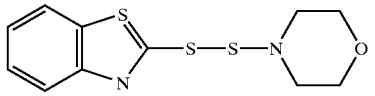

1-30

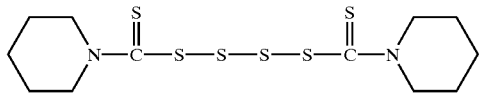

The compound of formula (1) may be incorporated directly or through solution in water or water-soluble solvents such as methanol or ethanol. Alternatively, the compound of formula (1) may be incorporated in the form of an emulsified dispersion or a solid particle dispersion. The compound of formula (1) may be added at any stage during the course of preparing silver halide emulsions or at any stage from after completion of emulsion preparation to immediately before coating. The compound of formula (1) is incorporated in an amount of $1\times10^{2}$ to 1 mol, and more preferably $1\times10^{-6}$ to $1\times10^{2}$ mol per mol of silver.

Silver halide photographic materials relating to the invention are preferably applied to those which have a donor layer capable of donating an interimage effect to the silver halide emulsion layer. Specifically, the present invention is preferably applied. An enhancement of radiation resistance achieved by the invention results in markedly improved color reproduction such as human skin color.

Besides the foregoing conditions in the preparation of silver halide emulsions can be selected optimal conditions, with reference to JP-A 61-6643, 61-14630, 61-112142, 62-157024, 62-18556, 63-92942, 63-151618, 63-163451, 63-220238 and 63-311244; RD 38957, Sect. I and III and RD40145, Sect. XV.

When making up color photographic material using the silver halide emulsion according to the invention, a silver halide emulsion which has been subjected to physical ripening, chemical ripening and spectral sensitization is employed. Additives used in such a process are described in RD 38957 Sect. V, and RD 40145 Sect, XV. Commonly known photographic additives usable in the invention include those described in RD 38957 sect. II to X and RD 40145 Sect. I to XIII.

The silver halide photographic material of the invention comprises red-, green- and blue-sensitive silver halide emulsion layers, in each of which a coupler can be contained. Dyes formed of the couplers contained in respective color-sensitive layers preferably exhibit an absorption maximum of at least 20 nm apart from each other. Cyan, magenta and yellow coupler are preferably used. Combinations of a yellow coupler and a blue-sensitive layer, a magenta coupler and a green-sensitive layer, and a cyan coupler and a red-sensitive layer are usually employed but the combination is not limited to this and other combinations are applicable.

DIR compounds can be used in the invention. Preferred examples of DIR compounds usable in the invention include compounds of D-1 through D-34 described in JP-A 4-114153. Example of other DIR compounds usable in the invention include those described in U.S. Pat. Nos. 4,234,678, 3,227,554, 3,647,291, 3,958,993, 4,419,886, 3,933,500; JP-A No. 57-56837, 51-13239; U.S. Pat. Nos. 2,072,363, 2,070,266; and RD 40145 Sect. XIV.

Exemplary examples of couplers usable in the invention are described in RD 40145 Sect. II.

Additives used in the invention may be incorporation through dispersing methods described in RD 40145 Sect. VIII. Commonly known supports, as described in RD 38957 Sect. XV are usable in the invention. There may be provided light-insensitive layer (or auxiliary layer), such as a filter layer or interlayer in photographic materials relating to the invention.

Photographic materials relating to the invention can be processed using developers described in T. H. James, The Theory of the Photographic Process, Forth Edition, page 291 to 334 and Journal of American Chemical Society, 73 [3] 100 (1951), according to the conventional methods described RD 38957 Sect. XVII to XX, and RD 40145 Sect. XXIII.

EXAMPLES

The present invention will be further described based on exemplary examples, but the invention is by no means limited to these examples. Hereinafter, the term, liter is also designated as L.

Example 1

Preparation of Silver Halide Emulsion

Preparation of Emulsion Em-1

Nucleation and Ripening Process

To aqueous gelatin solution (1), as described below, within a reaction vessel, maintained at 30° C. were added aqueous silver nitrate solution (1) and aqueous halide solution (1) by the double jet addition at a constant flow rate for a period of 1 min. to form nucleus grains.

| | |
|---|---|
| Aqueous gelatin solution (1) | |
| Alkali processed inert gelatin (average molecular weight of 100,000) | 9.02 g |
| Potassium bromide | 2.75 g |
| $H_2O$ | 3.6 lit. |
| Aqueous silver nitrate solution (1) | |
| Silver nitrate | 14.0 g |
| $H_2O$ | 62.8 ml. |

-continued

| Aqueous halide solution (1) | |
|---|---|
| Potassium bromide | 9.82 g |
| $H_2O$ | 62.4 ml |

Immediately after completing addition, the following aqueous gelatin solution (2) was added thereto and the temperature was raised to 60° C. in 30 min., then, the pH was adjusted to 5.0 and ripening was conducted for a period of 20 min.

| Aqueous gelatin solution (2) | |
|---|---|
| Alkali-processed inert gelatin (average molecular weight of 100,000) | 38.7 g |
| Surfactant (EO-1*, 10 wt% methanol solution) | 1.3 ml |
| $H_2O$ | 908.6 ml |
| *EO-1: $HO(CH_2CH_2O)_m[CH(CH_3)CH_2O]_{19.8}(CH_2CH_2O)_{12}H$ (m + n = 9.77) | |

Grain Growth Process (1)

Subsequently to completion of the nucleation and ripening process, aqueous silver nitrate solution (2) and aqueous halide solution (2) were added at an accelerated rate by double jet addition. After completion of addition, aqueous gelatin solution (3) was added and aqueous silver nitrate solution (2) and aqueous halide solution (2) were subsequently added at an accelerated rate, while the silver potential within the reaction vessel was maintained at 6 mV with a 1 mol/l potassium bromide solution, using a silver ion selection electrode and saturated silver—silver chloride electrode as a reference electrode.

| Aqueous silver nitrate solution (2) | |
|---|---|
| Silver nitrate | 172.0 g |
| $H_2O$ | 795.0 ml |
| Aqueous halide solution (2) | |
| Potassium bromide | 124.7 g |
| $H_2O$ | 792.7 ml |
| Aqueous gelatin solution (3) | |
| Alkali-processed inert gelatin (average molecular weight of 100,000) | 175.9 g |
| Surfactant (EO-1, 10 wt% methanol solution) | 0.67 ml |
| $H_2O$ | 4260.1 ml |
| Aqueous silver nitrate solution (3) | |
| Silver nitrate | 1907.6 g |
| $H_2O$ | 2769.5 ml |
| Aqueous halide solution (3) | |
| Potassium bromide | 1206.0 g |
| Potassium iodide | 55.9 g |
| $H_2O$ | 2719.3 ml |

Grain Growth Process (2)

After completion of the grain growth process (1), the following aqueous solution (A1) was added and then aqueous solution (B1) was added and adjusting the pH to 9.3 with a 1 mol/l potassium hydroxide solution, ripening was carried out to cause iodide ions to release. Thereafter, the pH was adjusted to 5.0 with a 1 mol/l nitric acid solution, then, the silver potential within the reaction vessel was adjusted to −19 mV with a 3.5 mol/l potassium bromide solution, and aqueous silver nitrate solution (4) and aqueous halide solution (4) were added at an accelerated flow rate.

| Aqueous solution (A1) | |
|---|---|
| Sodium p-iodoacetomidobenzenesulfonate | 83.5 g |
| $H_2O$ | 660.1 ml |
| Aqueous solution (B1) | |
| Sodium sulfite | 29.0 g |
| $H_2O$ | 312.9 ml |
| Aqueous silver nitrate solution (4) | |
| Silver nitrate | 900.3 g |
| $H_2O$ | 1307.0 ml |
| Aqueous halide solution (4) | |
| Potassium bromide | 611.7 g |
| Potassium iodide | 26.4 g |
| $H_2O$ | 1283.2 ml |

In the course of the grain growth process (2) and (3), the flow rate of addition of aqueous silver nitrate and halide solutions were each controlled so that no nucleation of silver halide occurred and deterioration in grain size distribution was not caused by Ostwald ripening among silver halide grains.

After completion of the foregoing grain growth stage, the emulsion was subjected to washing to remove soluble salts, re-dispersed with adding gelatin and the pH and pAg were adjusted to 5.8 and 8.1, respectively, to obtain Emulsion Em-1. The thus obtained silver halide emulsion was comprised of hexagonal tabular grains having an average grain diameter of 2.2 $\mu$m, a coefficient of variation of grain size distribution of 16% (hereinafter, also denoted simply as grain size distribution) and an average aspect ratio of 7. As a result of a transmission type electron microscopic observation, it was proved that silver halide grains having at least 5 dislocation lines in the fringe portion accounted for 90% of the total grain projected area and silver halide grains having at least 20 dislocation lines in the fringe portion accounted for 70% of the total grain projected area. It was further proved that tabular silver halide grains accounted for 20% by number, in which the ratio of A6/A7 was 0.91, the shell (V1) in the dislocation line forming region accounted for 30% of the grain volume and having an average iodide content (A1) of 3 mol %, the outermost sub shell (V2) in the shell (V1) in the dislocation line forming region was not present, and I3>I4.

Preparation of Emulsion Em-2

Emulsion Em-2 was prepared similarly to Em-1, provided that aqueous halide solution (3) used in the grain growth process (1) was replaced by aqueous halide solution (3a) shown below, aqueous halide solution (4) used in the grain growth process (2) was replaced by aqueous halide solution (4a) shown below, and subsequently to the addition of aqueous silver nitrate solution (4) and aqueous halide solution (4a), aqueous silver nitrate solution (5) and aqueous halide solution (5) were added by double jet addition at a constant flow rate for 5 min.

| | |
|---|---|
| Aqueous halide solution (3a) | |
| Potassium bromide | 1309.4 g |
| Potassium iodide | 37.3 g |
| $H_2O$ | 2720.0 ml |
| Aqueous halide solution (4a) | |
| Potassium bromide | 599.1 g |
| Potassium iodide | 44.0 g |
| $H_2O$ | 1282.1 ml |
| Aqueous silver nitrate solution (5) | |
| Silver nitrate | 60.0 g |
| $H_2O$ | 268.7 ml |
| Aqueous halide solution (5) | |
| Potassium bromide | 41.6 g |
| Potassium iodide | 0.6 g |
| $H_2O$ | 267.2 ml |

The thus obtained silver halide emulsion was comprised of hexagonal tabular grains having an average grain diameter of 2.2 μm, a grain size distribution of 16% and an average aspect ratio of 7. As a result of a transmission type electron microscopic observation, it was proved that silver halide grains having at least 5 dislocation lines in the fringe portion accounted for 90% of the total grain projected area and silver halide grains having at least 20 dislocation lines in the fringe portion accounted for 70% of the total grain projected area. It was further proved that tabular silver halide grains accounted for 40% by number, in which the ratio of A6/A7 was 0.38, the shell (V1) in the dislocation line forming region accounted for 31.2% of the grain volume and having an average iodide content (A1) of 4.8 mol %, the outermost sub-shell (V2) within the shell (V1) in the dislocation line forming region accounted for 2% of the grain volume and having an average iodide content (A2) of 1 mol %, and I3>I4.

Preparation of Emulsion Em-3

Emulsion Em-3 was prepared similarly to Em-2, provided that in place of aqueous silver nitrate solution (5) and aqueous halide solution (5) used in the grain growth process (2), aqueous silver nitrate solution (5a) and halide solution (5a) were added by double jet addition at a constant flow rate for 10 min.

| | |
|---|---|
| Aqueous silver nitrate solution (5a) | |
| Silver nitrate | 180.0 g |
| $H_2O$ | 206.1 ml |
| Aqueous halide solution (5a) | |
| Potassium bromide | 126.1 g |
| $H_2O$ | 801.7 ml |

The thus obtained silver halide emulsion was comprised of hexagonal tabular grains having an average grain diameter of 2.2 μm, a grain size distribution of 16% and an average aspect ratio of 7. As a result of a transmission type electron microscopic observation, it was proved that silver halide grains having at least 5 dislocation lines in the fringe portion accounted for 90% of the total grain projected area and silver halide grains having at least 20 dislocation lines in the fringe portion accounted for 70% of the total grain projected area. It was further proved that tabular silver halide grains accounted for 80% by number, in which the ratio of A6/A7 was 0.44, the shell (V1) in the dislocation line forming region accounted for 34.0% of the grain volume and having an average iodide content (A1) of 4.2 mol %, the outermost sub-shell (V2) within the shell (V1) in the dislocation line forming region accounted for 5.7% of the grain volume and having an average iodide content (A2) of 0 mol %, and I3>I4.

Preparation of Emulsion Em 4

Emulsion Em-4 was prepared similarly to Em-3, provided that aqueous gelatin solution (2) used in the nucleation and ripening process was replaced by aqueous gelatin solution (2a), aqueous halide solution (3a) used in the grain growth process (1) was replaced by aqueous halide solution (3b), the silver potential in the grain growth process (1) was adjusted to −4 mV, and aqueous solutions (A1) and (B1) were replaced by aqueous solution (A1a) and (B1b).

| | |
|---|---|
| Aqueous gelatin solution (2a) | |
| Alkali processed inert gelatin (average molecular weight of 100,000) | 38.7 g |
| Surfactant (EO-1, 10 wt% methanol solution) | 0.5 ml |
| $H_2O$ | 2725.8 ml |
| Aqueous halide solution (3b) | |
| Potassium bromide | 1329.5 g |
| Potassium iodide | 9.3 g |
| $H_2O$ | 2721.6 ml |
| Aqueous solution (A1a) | |
| Sodium p-iodoacetoamidobenzenesulfonate | 102.7 g |
| $H_2O$ | 770.1 ml |
| Aqueous solution (B1a) | |
| Sodium sulfite | 35.6 g |
| $H_2O$ | 352.9 ml |

The thus obtained silver halide emulsion was comprised of hexagonal tabular grains having an average grain diameter of 2.8 μm, a grain oxide distribution of 18% and an average aspect ratio of 15. As a result of a transmission type electron microscopic observation, it was proved that silver halide grains having at least 5 dislocation lines in the fringe portion accounted for 90% of the total grain projected area and silver halide grains having at least 20 dislocation lines in the fringe portion accounted for 70% of the total grain projected area. It was further proved that tabular silver halide grains accounted for 85% by number, in which the ratio of A6/A7 was 0.11, the shell (V1) in the dislocation line forming region accounted for 34.0% of the grain volume and having an average iodide content (A1) of 4.2 mol %, the outermost sub-shell (V2) within the shell (V1) in the dislocation line forming region accounted for 5.7% of the grain volume and having an average iodide content (A2) of 0 mol %, and I3>I4.

Preparation of Emulsion Em-5

Emulsion was prepared using the following solutions:

| | |
|---|---|
| Solution A-22 | |
| Gelatin (av. M.W. of 15,000) | 35.9 g |
| Potassium bromide | 23.1 g |
| Water to make | 6200 ml |

-continued

| | |
|---|---|
| Solution B-22 | |
| 1.9 N Aqueous silver nitrate | 149.4 ml |
| Solution C-22 | |
| 3.5 N Aqueous silver nitrate | 6281 ml |
| Solution E-22 | |
| Potassium bromide | 33.8 g |
| Water to make | 149.4 ml |
| Solution F-22 | |
| Potassium bromide | 1978 g |
| Potassium iodide | 145.3 g |
| Water to make | 5000 ml |
| Solution G-22 | |
| Potassium bromide | 1212 g |
| Potassium iodide | 52.3 g |
| Water to make | 3000 ml |
| Solution I-22 | |
| Potassium bromide | 208.3 g |
| Water to make | 1000 ml |
| Solution K-22 | |
| Gelatin | 33.9 g |
| Potassium bromide | 6.16 g |
| 10 wt% Methanol solution of $HO(CH_2CH_2O)_m[CH(CH_3)CH_2O]_{19.8}(CH_2CH_2O)_nH$ (m + n = 9.77) | 0.33 ml |
| Water to make | 953 ml |
| Solution L-22 | |
| Gelatin | 339.8 g |
| 10 wt% Methanol solution of $HO(CH_2CH_2O)_m[CH(CH_3)CH_2O]_{19.8}(CH_2CH_2O)_nH$ (m + n = 9.77) | 1.3 ml |
| Water to make | 17228 ml |
| Solution M-22 | |
| Potassium bromide | 624.8 g |
| Water to make | 1500 ml |

Solution A-22 was added to the reaction vessel and solutions B-22 and E-22 were added by the simultaneous double jet addition at a constant flow rate for 70 sec., while vigorously stirring at 30° C. Then, solution K-22 was added and the temperature was raised to 70° C. Thereafter, solution L-22 was added, the pAq was adjusted to 8.2 with solution C-22, and 4169 ml of solution C-22 and solution F-22 were simultaneously added by double jet addition at an accelerated flow rate (8 times faster at the end than at the start) for 112 min., while maintaining the pAg at 8.2. Then, the temperature was lowered to 60° C. Subsequently, the pAg was adjusted to 9.7 with solution M-22 and then, remaining solution C-22 and solution G-22 were added by double jet addition at an accelerated flow rate (2 times faster at the end than at the start) for 55 min. to obtain a silver halide tabular grain emulsion, while solution I-22 was optimally added to control the pAg. After completion of grain formation, the emulsion was subjected to washing to remove soluble salts in accordance with the method described in JP-A 5-72658, then, gelatin was added thereto to disperse the emulsion, and the pAg and pH were each adjusted to 8.06 and 5.8 at 40° C. As a result of electron microscopic observation, the thus obtained emulsion was comprised of tabular silver halide grains having an average grain size (i.e., equivalent circular diameter) of 1.2 $\mu$m and average thickness of 0.17 $\mu$m.

Preparation of Emulsion Em-6

Emulsion was prepared using the following solutions.

| | |
|---|---|
| Solution A-23 | |
| Gelatin | 7.5 g |
| Potassium bromide | 9.5 g |
| Water to make | 12.0 l |
| Solution B-23 | |
| 1.0 N Aqueous silver nitrate | 27.0 ml |
| Solution C 22 | |
| Potassium bromide | 3.16 g |
| Potassium iodide | 7 mg |
| Water to make | 27.0 ml |
| Solution C-23 | |
| Oxone (trade name, $2KHSO_5.KHSO_4.K_2SO_4$, available from Aldrich Co.) | 300 mg |
| Water to make | 40 ml |
| Solution E-23 | |
| Gelatin (methionine content of 8 $\mu$mol per gram of gelatin) | 180 g |
| water to make | 3000 ml |
| Solution F-23 | |
| 1N potassium bromide solution | 245 ml |
| Solution C 23 | |
| 2N silver nitrate solution | 850 ml |
| Solution H-23 | |
| Potassium bromide | 228.5 g |
| Potassium iodide | 13.3 g |
| Water to make | 1000 ml |
| Solution I-23 | |
| 3.5N silver nitrate solution | 4657 ml |
| Solution J-23 | |
| Potassium bromide | 1999 g |
| Potassium iodide | 116.2 g |
| Water to make | 5000 ml |

Solution A-23 was added to the reaction vessel, the pH was adjusted to 2 and solutions B-23 and C-23 were simultaneously added by double jet addition with vigorously stirring at 40° C. Then solution D-23 was added and the temperature was raised to 55° C. Ripening was carried out for 10 min., then, solution E-23 was added and the pH was adjusted to 6 with aqueous potassium hydroxide. Solution F-23 was added, then, solutions G-23 and H-23 were added by double jet addition with maintaining the pAg and subsequently, solutions I-23 and J-23 were added by double jet addition. After completion of grain formation, the emulsion was subjected to washing to remove soluble salts in accordance with the conventional, then, gelatin was added thereto to disperse the emulsion, and the pAg and pH were each adjusted to 8.06 and 5.8 at 40° C. As a result of electron microscopic observation, the thus obtained emulsion was comprised of tabular silver halide grains having an average grain size (i.e., equivalent circular diameter) of 1.9 $\mu$m and average thickness of 0.05 $\mu$m.

Preparation of Emulsion Em-1A to Em-3A

The thus obtained emulsions Em-1 to Em 3 were each heated to 52° C. and adding sensitizing dye SD-8 of $2.7\times10^{-4}$ mol per mol of silver halide, SD-9 of $1.5\times10^{-5}$ mol per mol of silver halide, SD-10 of $1.77\times10^{-5}$ mol per mol of silver halide, triphenylphosphine selenide of $2.5\times10^{-6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate penta-hydrate of $5.5\times10^{6}$ mol per mol of silver halide, the emulsion was ripened at a silver potential of 90 mV and a pH of 5.5 so as to achieve optimum sensitivity. After completion of ripening, $7.5\times10^{-3}$ mol per mol of silver halide of 6-methyl-4-hydroxy-1,3,3a,7-tetrazaindene and $2.5\times10^{-4}$ mol per mol of silver halide of 1-phenyl-5-mercaptotetrazole were added and the emulsion was cooled to be set to obtain silver halide emulsions Em-1A to Em-3A.

Preparation of Emulsion Em-4A

Emulsions Em-4 was heated to 52° C. and adding sensitizing dye SD-8 of $3.5\times10^{-4}$ mol per mol at silver halide, SD-9 of $2.0\times10^{5}$ mol per mol of silver halide, SD-10 of $2.2\times10^{-5}$ mol per mol of silver halide, triphenylphosphine selenide of $2.5\times10^{-6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate pentahydrate of $5.5\times10^{-6}$ mol per mol of silver halide, the emulsion was ripened at a silver potential of 90 mV and a pH of 5.5 so as to achieve optimum sensitivity. After completion of ripening, $7.5\times10^{-3}$ mol per mol of silver halide of 6-methyl-4-hydroxy-1,3,3a,7-tetrazaindene and $2.5\times10^{-4}$ mol per mol of silver halide of 1-phenyl-5-mercaptotetrazole were added and the emulsion was cooled to be set to obtain silver halide emulsions Em-4A.

Preparation of Emulsion Em-1B

Emulsions Em-1 was heated to 52° C. and adding sensitizing dye SD-8 of $2.7\times10^{-4}$ mol per mol of silver halide, SD-9 of $1.5\times10^{-5}$ mol per mol of silver halide, SD 10 of $1.7\times10^{-5}$ mol per mol of silver halide, triphenylphosphine selenide of $2.5\times10^{-6}$ mol per mol of silver halide, chloroauric acid of $3.2\times10^{-6}$ mol per mol of silver halide potassium thiocyanate of $3.5\times10^{-4}$ mol per mol of silver halide and sodium thiosulfate penta-hydrate of $5.5\times10^{-6}$ mol per mol of silver halide, the emulsion was ripened at a silver potential of 90 mV and a pH of 5.5 so as to achieve optimum sensitivity. After completion of ripening, $7.5\times10^{-3}$ mol per mol of silver halide of 6-methyl-4-hydroxy-1,3,3a,7-tetrazaindene and $2.0\times10^{-4}$ mol per mol of silver halide of compound (1–6) were added and the emulsion was cooled to be set to obtain silver halide emulsions Em-1B.

Preparation of Emulsion Em-1D

Emulsions Em-1 was heated to 52° C. and adding sensitizing dye SD-8 of $2.7\times10^{-4}$ mol per mol of silver halide, SD-9 of $1.5\times10^{-5}$ mol per mol of silver halide, SD-10 of $1.7\times10^{5}$ mol per mol or silver halide, tellurium compound (Te-3) of $2.5\times10^{-6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate penta-hydrate of $5.5\times10^{-6}$ mol per mol of silver halide, the emulsion was ripened at a silver potential of 50 mV and a pH of 6.3 so as to achieve optimum sensitivity. After completion of ripening, $7.5\times10^{-3}$ mol per mol of silver halide of 6-methyl-4-hydroxy-1,3,3a,7-tetrazaindene and $2.0\times10^{-4}$ mol per mol of silver halide of compound (1–6) were added and the emulsion was cooled to be set to obtain silver halide emulsions Em-1D.

Preparation of Emulsion Em-4B

Emulsions Em-4 was heated to 52° C. and adding sensitizing dye SD-8 of $3.5\times10^{-4}$ mol per mol of silver halide, SD-9 of $2.0\times10^{-5}$ mol per mol of silver halide, SD-10 of $2.2\times10^{-5}$ mol per mol of silver halide, triphenylphosphine selenide of $2.5\times10^{-6}$ mol per mol of silver halide, chloroauric acid of $3.2\times10^{-4}$ mol per mol of silver halide, potassium thiocyanate of $3.5\times10^{-4}$ mol per mol of silver halide and sodium thiosulfate penta-hydrate of $5.5\times10^{-5}$ mol per mol of silver halide, the emulsion was ripened at a silver potential of 50 mV and a pH of 6.3 so as to achieve optimum sensitivity. After completion or ripening, $7.5\times10^{-3}$ mol per mol of silver halide of 5methyl-4-hydroxy-1,3,3a,7-tetrazaindene and $2.0\times10^{-4}$ mol per mol of silver halide of compound (1–6) were added and the emulsion was cooled to be set to obtain silver halide emulsions Em-4B.

Preparation of Color Photographic Material

On a 120 $\mu$m, subbed triacetyl cellulose film support, the following layers having composition as shown below were formed to prepare a multi-layered color photographic material sample. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol. Thus, Samples 1001 to 1008 were prepared using each of the foregoing emulsions Em-1A to Em-4A, Em-1B, Em-1D and Em-4B as a silver iodobromide emulsion A used in the 9th layer, and the foregoing emulsions Em-5 and Em-6 as silver iodobromide emulsion B used in the 8th layer, wherein sensitizing dyes used in the 9th layer (designated as "SD") were contained in amounts equivalent to those used in the preparation of emulsions Em-1A to Em-4A, Em-1B, Em-1D or Em-4B.

| | |
|---|---|
| 1st Layer; Anti-Halation Layer | |
| Black colloidal silver | 0.16 |
| UV-1 | 0.30 |
| CM-1 | 0.12 |
| OIL-1 | 0.24 |
| Gelatin | 1.33 |
| 2nd Layer: Interlayer | |
| Silver iodobromide emulsion i | 0.06 |
| AS-1 | 0.12 |
| OIL-1 | 0.15 |
| Gelatin | 0.67 |
| 3rd Layer: Low-speed Red-Sensitive Layer | |
| Sliver iodobromide emulsion h | 0.39 |
| Silver iodobrornide emulsion e | 0.32 |
| SD-1 | $2.2\times10^{-5}$ |
| SD-2 | $6.7\times10^{-5}$ |
| SD-3 | $1.5\times10^{-4}$ |
| SD-4 | $1.4\times10^{-4}$ |
| SD-5 | $1.4\times10^{-4}$ |
| C-1 | 0.77 |
| CC-1 | 0.006 |
| OIL-2 | 0.47 |
| AS-2 | 0.002 |
| Gelatin | 1.79 |
| 4th Layer: Medium-speed Red-sensitive Layer | |
| Silver iodobromide emulsion b | 0.86 |
| Silver iodobromide emulsion h | 0.37 |
| SD-1 | $1.8\times10^{-5}$ |
| SD-4 | $2.5\times10^{-4}$ |
| SD-5 | $2.6\times10^{-4}$ |
| C-1 | 0.42 |
| CC-1 | 0.072 |
| DI-1 | 0.046 |
| OIL-2 | 0.27 |
| AS-2 | 0.003 |
| Gelatin | 1.45 |
| 5th Layer: High-speed Red-Sensitive Layer | |
| Silver iodobromide emulsion a | 1.45 |

-continued

| | |
|---|---|
| Silver iodobromide emulsion e | 0.076 |
| SD-1 | $3.0 \times 10^{-5}$ |
| SD-4 | $2.1 \times 10^{-4}$ |
| SD-5 | $1.4 \times 10^{-4}$ |
| C-2 | 0.10 |
| C-3 | 0.17 |
| CC-1 | 0.013 |
| DI-5 | 0.044 |
| OIL-2 | 0.17 |
| AS-2 | 0.004 |
| Gelatin | 1.40 |
| 6th Layer: Interlayer | |
| Y-1 | 0.095 |
| AS-1 | 0.11 |
| OIL-1 | 0.17 |
| Gelatin | 1.00 |
| 7th Layer-: Low-speed Green-Sensitive Layer | |
| Silver iodobromide emuloson h | 0.32 |
| Silver iodobromide emulsion e | 0.11 |
| SD-6 | $3.5 \times 10^{-5}$ |
| SD-7 | $3.1 \times 10^{-4}$ |
| SD-8 | $2.1 \times 10^{-4}$ |
| SD-9 | $1.3 \times 10^{4}$ |
| SD-10 | $2.7 \times 10^{-5}$ |
| M-1 | 0.19 |
| M-3 | 0.20 |
| CM-1 | 0.042 |
| DI-2 | 0.010 |
| OIL-1 | 0.41 |
| AS-2 | 0.002 |
| AS-3 | 0.067 |
| Gelatin | 1.24 |
| 8th Layer: Medium-speed Green-Sensitive Layer | |
| Silver iodobromide emulsion B | 0.54 |
| Silver iodobromide emulsion e | 0.23 |
| SD-8 | $3.0 \times 10^{4}$ |
| SD-9 | $1.7 \times 10^{-4}$ |
| SD-10 | $2.4 \times 10^{-5}$ |
| M-1 | 0.058 |
| M-3 | 0.094 |
| CM 1 | 0.042 |
| CM-2 | 0.044 |
| DI-2 | 0.025 |
| OIL-1 | 0.27 |
| AS-3 | 0.046 |
| AS-4 | 0.006 |
| Gelatin | 1.22 |
| 9th Layer: High-speed Green-Sensitive Layer | |
| Silver iodobromide emulsion A | 1.11 |
| Silver iodobromide emulsion b | 0.13 |
| Silver iodobromide emulsion e | 0.066 |
| SD-6 | $2.8 \times 10^{-6}$ |
| SD 7 | $2.6 \times 10^{-5}$ |
| SD-8 | $3.2 \times 10^{-4}$ |
| SD-9 | $1.7 \times 10^{-5}$ |
| SD-10 | $2.0 \times 10^{-5}$ |
| SD-11 | $1.2 \times 10^{4}$ |
| M-1 | 0.046 |
| M-2 | 0.070 |
| CM-2 | 0.010 |
| DI-3 | 0.003 |
| OIL-1 | 0.22 |
| AS-2 | 0.008 |
| AS-3 | 0.035 |
| Gelatin | 1.38 |
| 10th Layer: Yellow Filter Layer | |
| Yellow colloidal silver | 0.053 |
| AS-1 | 0.15 |
| OIL-1 | 0.18 |
| Gelatin | 0.83 |
| 11th Layer: Low-speed Blue-sensitive Layer | |
| Silver iodobromide emulsion g | 0.29 |
| Silver iodobromide emulsion d | 0.098 |

-continued

| | |
|---|---|
| Silver iodobromide emulsion c | 0.098 |
| SD-12 | $1.6 \times 10^{-4}$ |
| SD 13 | $2.2 \times 10^{-4}$ |
| SD-14 | $1.1 \times 10^{-4}$ |
| SD-15 | $3.2 \times 10^{-4}$ |
| Y-1 | 0.95 |
| OIL-1 | 0.29 |
| AS-2 | 0.0014 |
| X-1 | 0.10 |
| Gelatin | 1.79 |
| 12th Layer: High-sped Blue-sensitive Layer | |
| Silver iodobromide emulsion f | 1.14 |
| Silver iodobromide emulsion g | 0.32 |
| SD-12 | $7.4 \times 10^{-5}$ |
| SD-15 | $3.0 \times 10^{-4}$ |
| Y-1 | 0.31 |
| DI-5 | 0.11 |
| OIL-1 | 0.17 |
| AS-2 | 0.010 |
| X-1 | 0.098 |
| Gelatin | 1.15 |
| 13th Layer: First Protective Layer | |
| Silver iodobromide emulsion 1 | 0.20 |
| UV-1 | 0.11 |
| UV-2 | 0.055 |
| X-1 | 0.078 |
| Gelatin | 0.70 |
| 14th Layer: Second protective Layer | |
| PM 1 | 0.13 |
| PM-2 | 0.018 |
| WAX-1 | 0.021 |
| Gelatin | 0.55 |

Characteristics of silver iodobromide emulsions described above are shown below, in which the average grain size refers to an edge length of a cube having the same volume as that of the grain.

TABLE 1

| Emulsion | Av. Grain Size (μm) | Av. Iodide Content (mol %) | Diameter/thickness Ratio |
|---|---|---|---|
| a | 1.0 | 3.2 | 7.0 |
| b | 0.70 | 3.3 | 6.5 |
| c | 0.30 | 1.9 | 5.5 |
| d | 0.38 | 8.0 | Octahedral, twinned |
| e | 0.27 | 2.0 | Tetradehedral twinned |
| f | 1.20 | 8.0 | 2.5 |
| g | 0.60 | 8.0 | 3.2 |
| h | 0.42 | 4.0 | Cubic |
| i | 0.03 | 2.0 | 1.0 |

With regard to the foregoing emulsions, except for emulsion i, after adding the foregoing sensitizing dyes to each of the emulsions, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizer ST-1 and ST-2; fog restrainer AF-1 and AF-2 comprising two kinds polyvinyl pyrrolidone of weight-averaged molecular weights of 10,000 and 1,100,000; inhibitors AF 3, AF-1 and AF-5; hardener H-1 and H 2; and anticeptic Aee-1.

Chemical structure for each of the compounds used in the foregoing sample are shown below.

Y-1
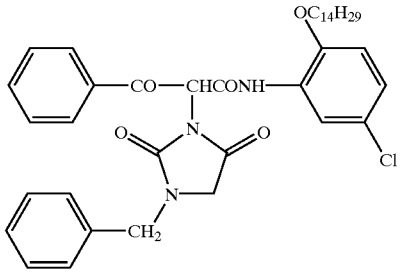
M-1
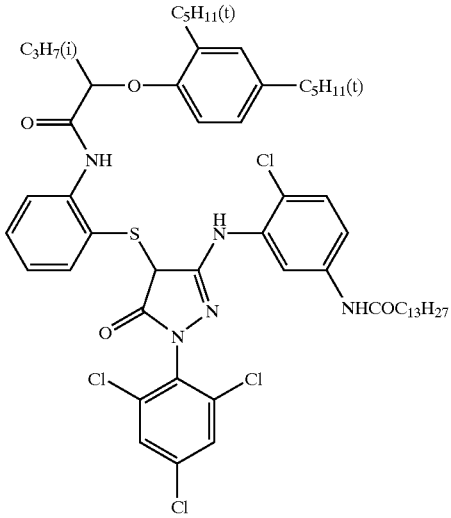
M-2
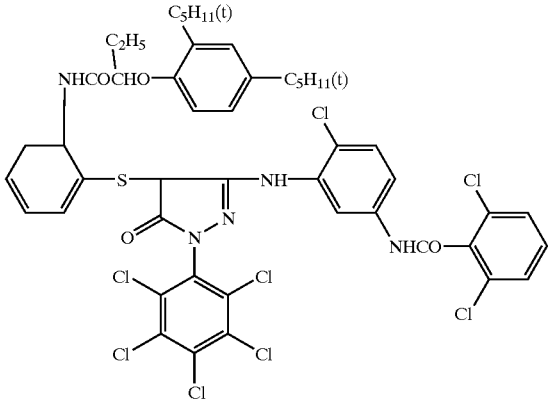
M-3
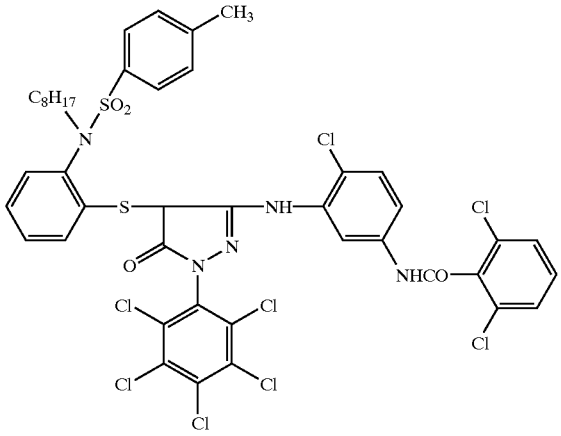
M-4
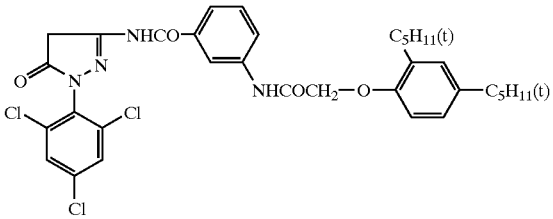
C-1
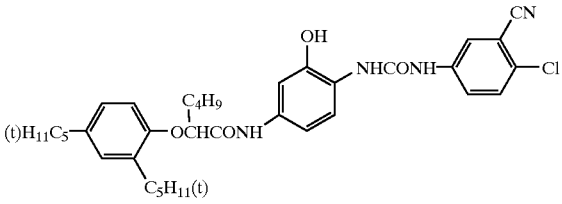
C-2
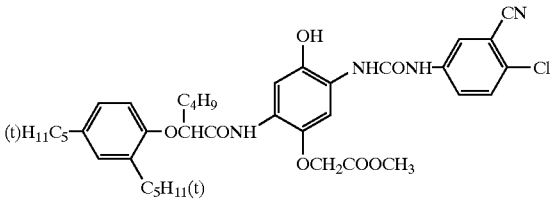
C-3
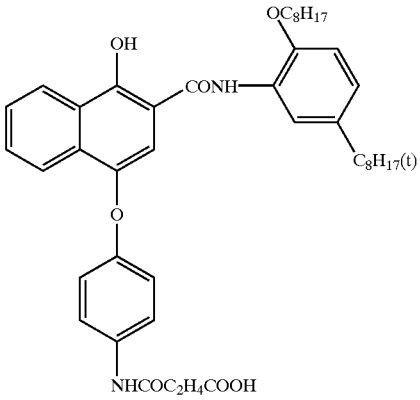

-continued
CC-1
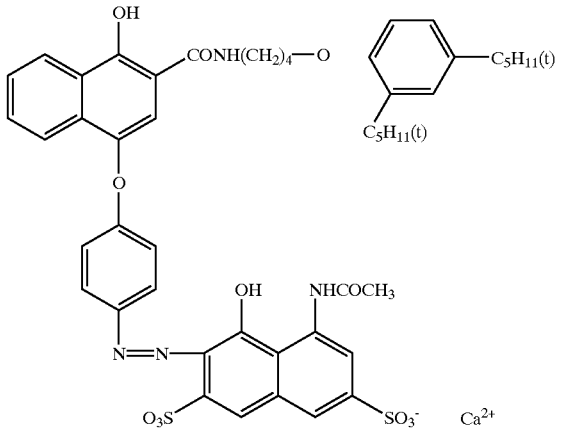
CM-1
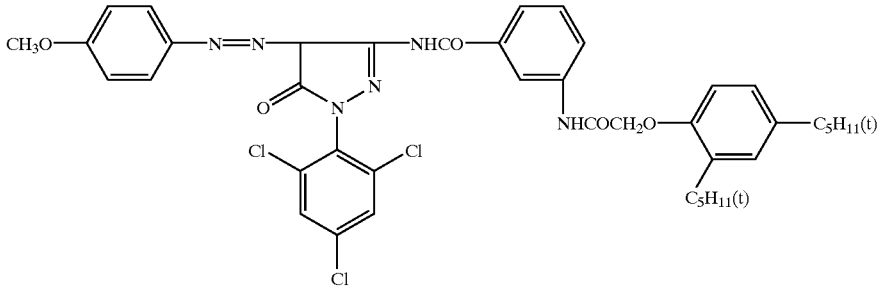
CM-2
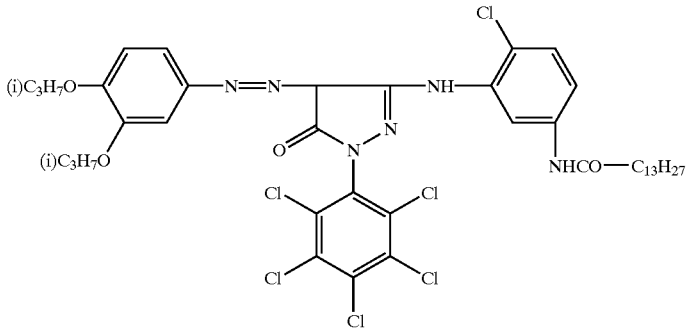
DI-1
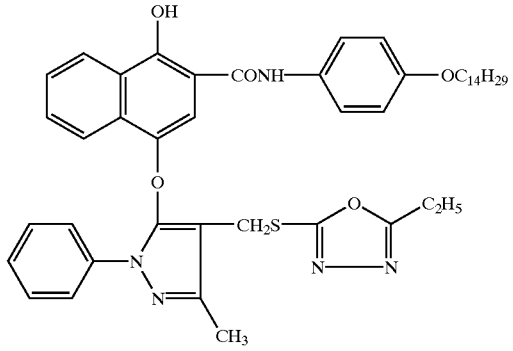
DI-2
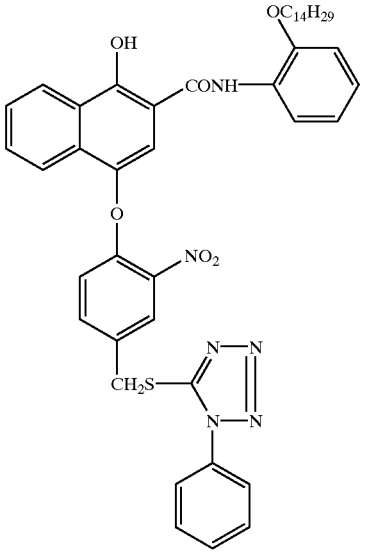

-continued
DI-3
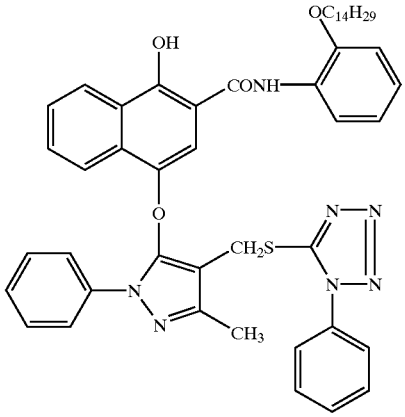
DI-4
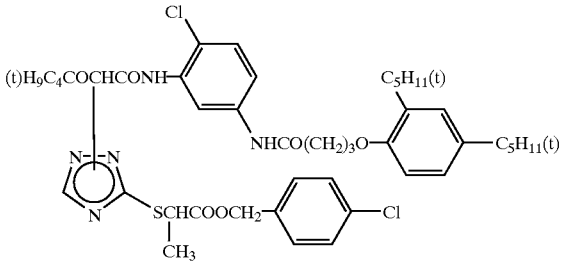
AS-1
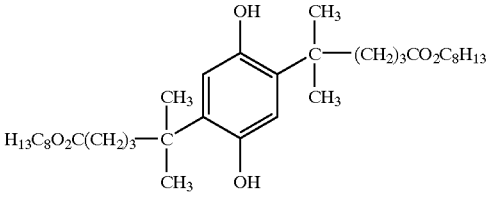
AS-2
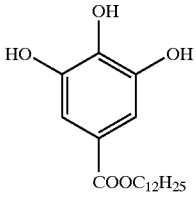
AS-3
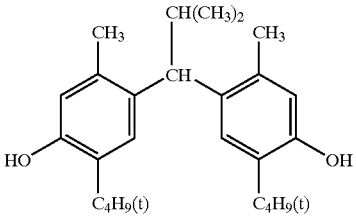
AS-4
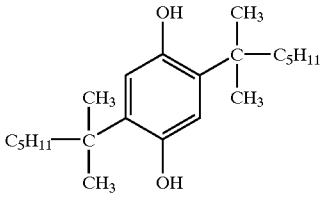
OIL-1
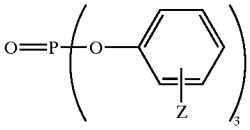
OIL-2
$H_9C_4OOC(CH_2)_8COOC_4H_9$
OIL-3
Liquid paraffin
UV-1
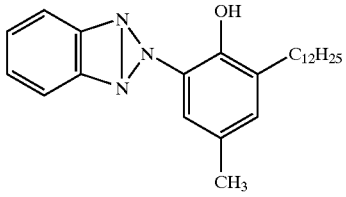
UV-2
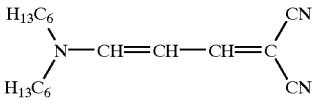
V-1
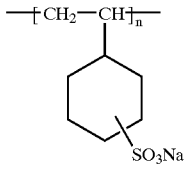
n: Degree of polymerization
Ase-1 (Mixture)
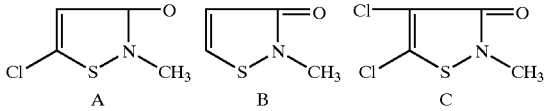
A : B : C = 50 : 46 : 4
H-1
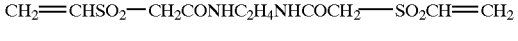

-continued
H-2
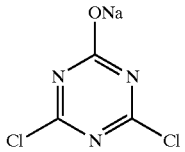
SD-1
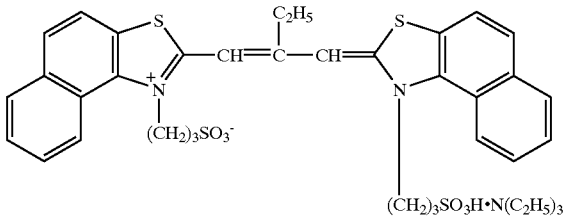
SD-2
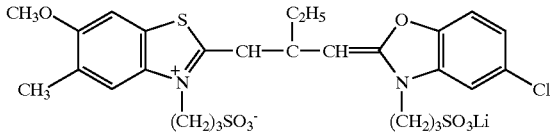
SD-3
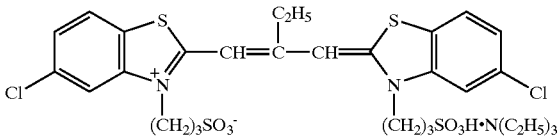
SD-4
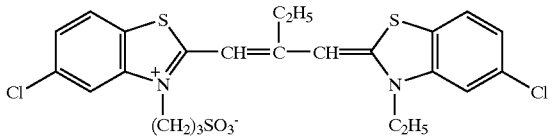
SD-5
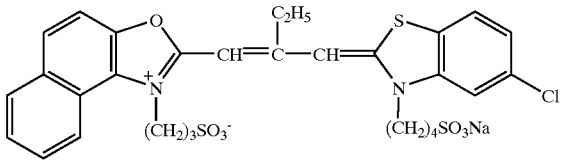
SD-6
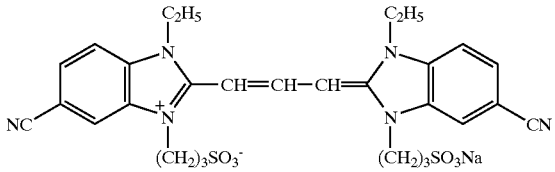
SD-7
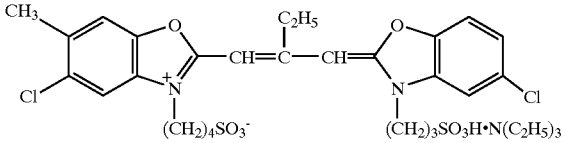
SD-8
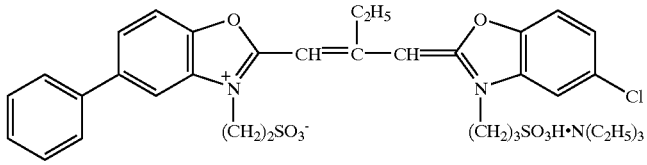
SD-9
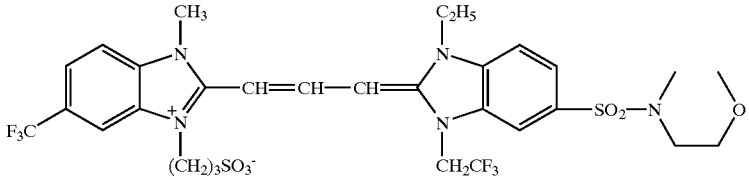
SD-10
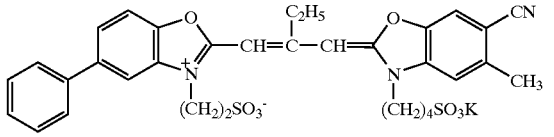
SD-11
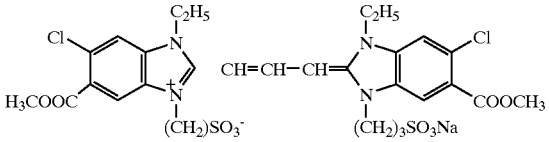
SD-12
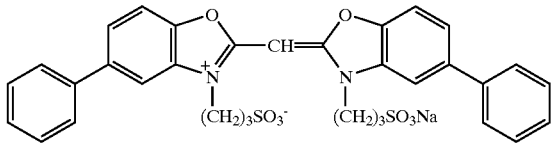
SD-13
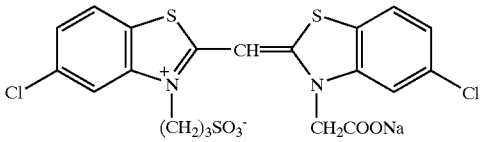

-continued

SD-14

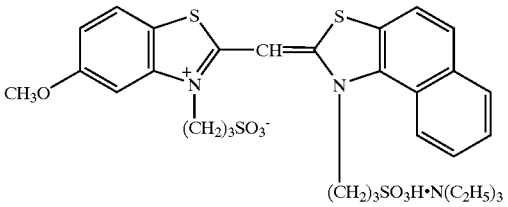

SD-15

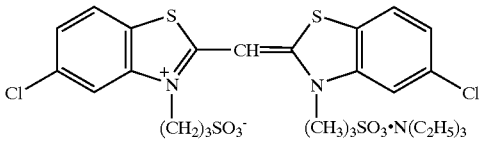

ST-1

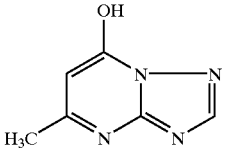

ST-2

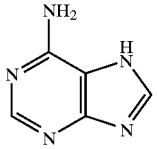

AF-1,2

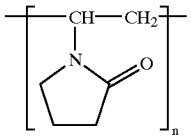

AF-1 Mw ≈ 10,000
AF-2 Mw ≈ 100,000 n: Degree of polymerization

AF 3

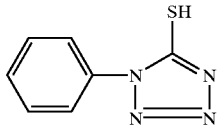

AF-4

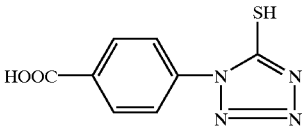

AF-5

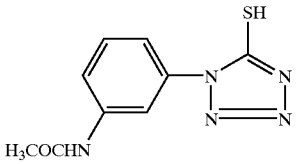

X-1

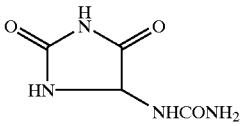

SU-1

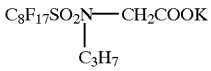

SU-2

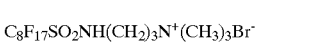

SU-3

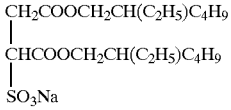

SU-4

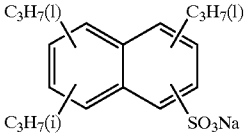

WAX-1

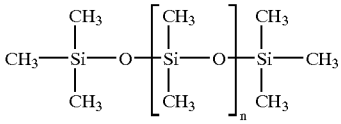

Mw = 3,000

PM-1

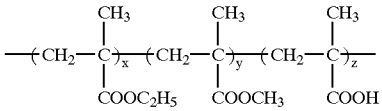

x : y : z = 3: 3: 4

PM-2

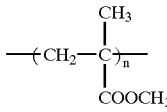

n: Degree of polymerization

For each of the thus prepared samples were prepared two parts, one of which was exposed to radiation of 200 mR dose using 137 Cs as a radiation source. The other part was not exposed to any radiation. Thereafter, exposure and processing were carried out for each sample. Thus, samples were each exposed to light through an optical stepped wedge for a period of 1/200 sec., using white light and then processed in accordance with the process described in JP-A 10-123652, col. [0220] through [0227]. Subsequently, processed samples were measured with respect to magenta density, using a densitometer produced by X-rite Co. A characteristic curve of density (D) and exposure (Log E) was prepared to evaluate sensitivity. Sensitivity was prepared by a value of the reciprocal of exposure necessary to give a magenta density of the minimum density plus 0.10. Sensitivity stability to radiation for each sample was evaluated based on the following formula:

$$\text{Sensitivity stability}=(\text{sensitivity of sample exposed to radiation})/(\text{sensitivity of sample unexposed to radiation})\times 100$$

Further, RMS granularity was measured (i.e., 1000 times value of variation in density occurred when a density of minimum density plus 0.30 was scanned with microdensitometer, product by Konica Corp. at a aperture scanning area of 250 $\mu m^2$). Stability of graininess to radiation (hereinafter, also denoted as graininess stability) was evaluated based on the following formula:

Graininess stability=(RMS value of sample exposed to radiation)/(RMS value of sample unexposed to radiation)×100

Samples and evaluation results thereof are shown in Table 2.

TABLE 2

| Sample No. | Emulsion A (9th layer) | Emulsion B (8th layer) | PGg/Sg | Sensitivity Stability | Graininess Stability |
|---|---|---|---|---|---|
| 1001 (Comp.) | Em-1A | Em-5 | 122 | 72 | 79 |
| 1004 (Inv.) | EM-2A | Em-5 | 72 | 91 | 94 |
| 1005 (Inv.) | Em-3A | Em-5 | 60 | 93 | 96 |
| 1006 (Inv.) | Em-4A | Em-5 | 54 | 95 | 96 |
| 1007 (Inv.) | Em-4B | Em-5 | 48 | 97 | 97 |
| 1008 (Inv.) | Em-4B | Em-6 | 40 | 98 | 99 |

As apparent from Table 2, Samples 1004 through 1008 relating to the invention exhibited superior results in sensitivity stability to radiation and graininess stability to radiation, relative to comparative Sample 1001.

Example 2

On a subbed triacetyl cellulose film support, the following layers having composition as shown below were formed to prepare a multi-layered color photographic material Sample 101. The addition amount of each compound was represented in term of g/m$^2$, unless otherwise noted. The amount of silver halide or colloidal silver was converted to the silver amount and the amount of a sensitizing dye (denoted as "SD") was represented in mol/Ag mol. Thus, Samples 1101 to 1108 were prepared using each of the foregoing emulsions Em-1A to Em-4A, Em-1B, Em-1D and Em-4B as silver iodobromide emulsion E used in the 9th layer, and the foregoing emulsions Em-5 and Em-6 as silver iodobromide emulsion C used in the 8th layer, wherein sensitizing dyes used in the 9th layer (designated as "SD") were contained in amounts equivalent to those used in the preparation of emulsion Em-1A to Em-4A, Em-1B, Em-1D or Em-4D.

| | |
|---|---|
| 1st Layer: Anti-Halation Layer | |
| Black colloidal silver | 0.20 |
| UV-1 | 0.30 |
| CM-1 | 0.040 |
| OIL-1 | 0.167 |
| Gelatin | 1.33 |
| 2nd Layer: Interlayer | |
| CM-1 | 0.10 |
| OIL-1 | 0.06 |
| Gelatin | 0.67 |
| 3rd Layer: Low-speed Red-Sensitive Layer | |
| Silver iodobromide emulsion a | 0.298 |
| Silver iodobromide emulzion b | 0.160 |
| SD 1 | $2.4 \times 10^{-5}$ |
| SD-2 | $9.6 \times 10^{-5}$ |
| SD-3 | $2.0 \times 10^{-4}$ |
| SD-4 | $8.9 \times 10^{5}$ |
| SD-5 | $9.2 \times 10^{-8}$ |

-continued

| | |
|---|---|
| C-1 | 0.56 |
| CC-1 | 0.046 |
| OIL-2 | 0.35 |
| AS-2 | 0.001 |
| Gelatin | 1.35 |
| 4th Layer.Medium-speed Red sensitive Layer | |
| Silver iodobromide emulsion o | 0.314 |
| Silver iodobromide emulsion d | 0.157 |
| SD-1 | $2.5 \times 10^{-5}$ |
| SD-2 | $5.6 \times 10^{5}$ |
| SD-3 | $1.2 \times 10^{-4}$ |
| SD-4 | $2.0 \times 10^{-4}$ |
| SD-5 | $2.2 \times 10^{-4}$ |
| C-1 | 0.36 |
| CC-1 | 0.052 |
| Dl-1 | 0.022 |
| OIL-2 | 0.22 |
| AS-2 | 0.001 |
| Gelatin | 0.82 |
| 5th Layer: High-speed Red-Sensitive Layer | |
| Silver iodobromide emulsion c | 0.094 |
| Silver iodobromide emulsion e | 0.856 |
| SD-1 | $3.6 \times 10^{-5}$ |
| SD-4 | $2.5 \times 10^{-4}$ |
| SD-5 | $2.0 \times 10^{-4}$ |
| C-2 | 0.17 |
| C-3 | 0.088 |
| CC-1 | 0.041 |
| DI-4 | 0.012 |
| OIL-2 | 0.16 |
| AS-2 | 0.002 |
| Gelatin | 1.30 |
| 6th Layer: Interlayer | |
| OIL-1 | 0.20 |
| AS-1 | 0.16 |
| Gelatin | 0.89 |
| 7th Layer: Low-speed Green-Sensitive Layer | |
| Silver iodobromide emulsion a | 0.19 |
| Silver iodobromide emulsion d | 0.19 |
| SD-6 | $1.2 \times 10^{-4}$ |
| SD-7 | $1.1 \times 10^{-4}$ |
| M-1 | 0.26 |
| CM 1 | 0.070 |
| OIL-1 | 0.35 |
| DI-2 | 0.007 |
| Gelatin | 1.10 |
| 8th Layer: Medium-speed Green-Sensitive Layer | |
| Silver iodobromide emulsion C | 0.41 |
| Silver iodobromide emulsion d | 0.19 |
| SD-6 | $7.5 \times 10^{-5}$ |
| SD-7 | $4.1 \times 10^{-4}$ |
| SD-8 | $3.0 \times 10^{-4}$ |
| SD-9 | $6.0 \times 10^{-5}$ |
| SD 10 | $3.9 \times 10^{-5}$ |
| M-1 | 0.05 |
| M-4 | 0.11 |
| CM-1 | 0.024 |
| CM-2 | 0.028 |
| DI-3 | 0.001 |
| Dl-2 | 0.010 |
| OIL-1 | 0.22 |
| AS-2 | 0.001 |
| Gelatin | 0.80 |
| 9th Layer: High-speed Green-Sensitive Layer | |
| Silver iodobromide emulsion a | 0.028 |
| Silver iodobromide emulsion B | 0.49 |
| SD 6 | $5.5 \times 10^{-6}$ |
| SD-7 | $5.2 \times 10^{-5}$ |
| SD-8 | $4.3 \times 10^{-6}$ |
| SD-10 | $2.6 \times 10^{-5}$ |
| SD-11 | $1.3 \times 10^{-4}$ |
| M-1 | 0.068 |
| CM-2 | 0.015 |

-continued

| | |
|---|---|
| Dl-3 | 0.029 |
| OIL-1 | 0.14 |
| OIL-3 | 0.13 |
| AS-2 | 0.001 |
| Gelatin | 1.00 |
| 10th Layer: Yellow Filter Layer | |
| Yellow colloidal silver | 0.06 |
| OIL-1 | 0.18 |
| AS-1 | 0.14 |
| Gelatin | 0.90 |
| 11th Layer: Low-speed Blue-sensitive Layer | |
| Silver iodobromide emulsion d | 0.11 |
| Silver iodobromide emulsion a | 0.15 |
| Silver iodobromide emulsion h | 0.11 |
| SD-12 | $1.0 \times 10^{-4}$ |
| SD-13 | $2.0 \times 10^{-4}$ |
| SD-14 | $1.6 \times 10^{-4}$ |
| SD-15 | $1.3 \times 10^{-4}$ |
| Y 1 | 0.71 |
| DI-3 | 0.016 |
| AS-2 | 0.001 |
| OIL-1 | 0.22 |
| Gelatin | 1.38 |
| 12th Layer: High-sped Blue-sensitive Layer | |
| Silver iodobromide emulsion h | 0.31 |
| Silver iodobromide emulsion i | 0.56 |
| SD-12 | $7.5 \times 10^{-5}$ |
| SD-15 | $4.0 \times 10^{-4}$ |
| Y-1 | 0.26 |
| DI 4 | 0.054 |
| AS-2 | 0.001 |
| OIL-1 | 0.13 |
| Gelatin | 1.06 |
| 13th Layer: First Protective Layer | |
| Silver iodobromide emulsion j | 0.20 |
| UV-1 | 0.11 |
| UV-2 | 0.055 |
| OIL-3 | 0.20 |
| Gelatin | 1.00 |
| 14th Layer: Second protective Layer | |
| PM-1 | 0.10 |
| PM-2 | 0.018 |
| WAX-1 | 0.020 |
| SU-1 | 0.002 |
| SU-2 | 0.002 |
| Gelatin | 0.55 |

Characteristics of silver iodobromide emulsions a through j described above are shown below, in which the average grain size refers to an edge length of a cube having the same volume as that of the grain.

TABLE 3

| Emulsion | Av. grain size (μm) | Av. iodide content (mol %) | Diameter/thickness ratio | Coefficient of variation (%) |
|---|---|---|---|---|
| a | 0.27 | 2.0 | 1.0 | 15 |
| b | 0.42 | 4.0 | 1.0 | 17 |
| c | 0.56 | 3.8 | 4.5 | 25 |
| d | 0.38 | 8.0 | 1.0 | 15 |
| e | 0.87 | 3.8 | 5.0 | 21 |
| f | 0.30 | 1.9 | 6.4 | 25 |
| g | 0.44 | 3.5 | 5.5 | 25 |
| h | 0.60 | 7.7 | 3.0 | 18 |
| i | 1.00 | 7.6 | 4.0 | 15 |
| j | 0.05 | 2.0 | 1.0 | 30 |

With regard to the foregoing emulsions, except for emulsion j, after adding the foregoing sensitizing dyes to each of the emulsion, triphenylphosphine selenide, sodium thiosulfate, chloroauric acid and potassium thiocyanate were added and chemical sensitization was conducted according to the commonly known method until relationship between sensitivity and fog reached an optimum point.

In addition to the above composition were added coating aids SU-1, SU-2 and SU-3; a dispersing aid SU-4; viscosity-adjusting agent V-1; stabilizers ST-1 and ST-2; fog restrainer AF-1 and AF-2 comprising two kinds polyvinyl pyrrolidone of weight-averaged molecular weights of 10,000 and 1,100,000; inhibitors AF 3, AF 4 and AF 5; hardener H-1 and H-2; and anticeptic Aee-1. Compounds used in the foregoing samples were the same as those used in Example 1.

Samples and evaluation results thereof are shown in Table 4.

TABLE 4

| Sample No. | Emulsion E (9th layer) | Emulsion C (8th layer) | PGg/Sg | Sensitivity Stability | Graininess Stability |
|---|---|---|---|---|---|
| 1101 (Comp.) | Em-1A | Em-5 | 120 | 68 | 78 |
| 1104 (Inv.) | Em-2A | Em-5 | 68 | 91 | 93 |
| 1105 (Inv.) | EM-3A | Em-5 | 57 | 93 | 95 |
| 1106 (Inv.) | Em-4A | Em-5 | 51 | 96 | 96 |
| 1107 (Inv.) | Em-4B | Em-5 | 45 | 97 | 98 |
| 1108 (Inv.) | Em-4B | Em-6 | 38 | 99 | 99 |

As apparent from Table 4, Samples 1104 through 1108 relating to the invention exhibited superior results in sensitivity stability to radiation and graininess stability to radiation, relative to comparative Sample 1101.

Example 3

Red-sensitive emulsions Em-1A2 through Em-4A2, Em-1B2 and Em-4B2 were respectively prepared by spectrally sensitizing emulsion Em-1A through Em-4A, Em-1B and Em-4B with the sensitizing dyes used in the 5th layer of multi-layered color photographic material samples of Example 1. Samples 1201 through 1207 were prepared and evaluated similarly to Example 1, provided that silver iodobromide emulsion a was replaced by each of the foregoing emulsions Em-1A2 through Em-4A2, Em-1B2 and Em-4B2. Thus, sensitivity stability and graininess stability were determined for each sample with respect to magenta and cyan, and evaluation was made based on the average of magenta and cyan sensitivity stabilities and the average of magenta and cyan graininess stabilities.

Samples and evaluation results thereof are shown in Table 5.

TABLE 5

| Sample No. | Emulsion A (9th Layer) | Emulsion a (5th Layer) | Emulsion B (8th Layer) | [(PGg/Sg) + (PGr/Sr)]/2 | Sensitivity Stability (average) | Graininess Stability (average) |
|---|---|---|---|---|---|---|
| 1201 (Comp.) | Em-1A | Em-1A2 | Em-5 | 119 | 78 | 75 |
| 1203 (Inv.) | Em-2A | Em-2A2 | Em-5 | 72 | 93 | 92 |
| 1204 (Inv.) | Em-3A | Em-3A2 | Em-5 | 65 | 95 | 95 |

TABLE 5-continued

| Sample No. | Emulsion A (9th Layer) | Emulsion a (5th Layer) | Emulsion B (8th Layer) | [(PGg/Sg) + (PGr/Sr)]/2 | Sensitivity Stability (average) | Graininess Stability (average) |
|---|---|---|---|---|---|---|
| 1205 (Inv.) | Em-4A | Em-4A2 | Em-5 | 60 | 97 | 97 |
| 1206 (Inv.) | Em-4B | Em-4B2 | Em-5 | 57 | 98 | 99 |
| 1207 (Inv.) | Em-4B | Em-4B2 | Em-6 | 50 | 99 | 99 |

As apparent from Table 5, Samples 1203 through 1207 relating to the invention exhibited superior results in sensitivity stability to radiation and graininess stability to radiation, relative to comparative Sample 1201.

Example 4

Multi-layered color photographic material samples 1301 through 1307 were prepared similarly to those of Example 2, provided that silver iodobromide emulsion e used in the 5th layer was replaced by any one of emulsion Em-1A2 through Em-4A2, Em-1B2 and Em-4B2. Further, sensitivity stability and graininess stability were similarly determined for each sample with respect to magenta and cyan, and evaluation was made based on the average of magenta and cyan sensitivity stabilities and the average of magenta and cyan graininess stabilities.

Samples and evaluation results thereof are shown in Table 6.

TABLE 6

| Sample No. | Emulsion E (9th Layer) | Emulsion e (5th Layer) | Emulsion C (8th Layer) | [(PGg/Sg) + (PGr/Sr)]/2 | Sensitivity Stability (average) | Graininess Stability (average) |
|---|---|---|---|---|---|---|
| 1301 (Comp.) | Em-1A | Em-1A2 | Em-5 | 124 | 76 | 77 |
| 1303 (Inv.) | Em-2A | Em-2A2 | Em-5 | 68 | 93 | 93 |
| 1304 (Inv.) | Em-3A | Em-3A2 | Em-5 | 62 | 95 | 95 |
| 1305 (Inv.) | Em-4A | Em-4A2 | Em-5 | 58 | 96 | 97 |
| 1306 (Inv.) | Em-4B | Em-4B2 | Em-5 | 53 | 98 | 98 |
| 1307 (Inv.) | Em-4B | Em-4B2 | Em-6 | 47 | 99 | 99 |

As apparent from Table 6, Samples 1303 through 1307 relating to the invention exhibited superior results in sensitivity stability to radiation and graininess stability to radiation, relative to comparative Sample 1201.

Example 5

Preparation of Seed Emulsion T-1

Seed emulsion T-1 comprising seed crystal grains having two parallel twin planes was prepared in the following manner.

| | |
|---|---|
| Solution A-3 | |
| Ossein gelatin | 85.0 g |
| Potassium bromide | 26.0 g |
| Water to make | 34.0 l |
| Solution B-3 | |
| 1.25N Aqueous silver nitrate solution | 8533 ml |
| Solution C-3 | |
| 1.25N Aqueous potassium bromide solution | 9000 ml |
| Solution D-3 | |
| Ossein gelatin | 365.0 g |
| Surfactant (EO-1*, 10 wt % methanol solution) | 12.0 ml |
| Water to make | 9000 ml |
| *EO-1: $HO(CH_2CH_2O)_m[CH(CH_3)CH_2O]_{19.8}(CH_2CH_2O)_nH$ (m + n = 9.77) | |
| Solution E-3 | |
| Sulfuric acid (10%) | 200 ml |
| Solution F-3 | |
| 56% Aqueous acetic acid solution | necessary amount |
| Solution G-3 | |
| Aqueous ammonia (28%) | 250 ml |
| Solution H-3 | |
| Aqueous potassium hydroxide (10%) | necessary amount |
| Solution I-3 | |
| 1.75N aqueous potassium bromide | necessary amount |

To solution A-3 at 30° C. with stirring by a stirring apparatus described in JP A 62 160128 was added solution E3 and then solutions B-3 and C-3, 600 ml each were added by double jet addition at a constant flow rate for 1 min. to form silver halide nucleus grains. Subsequently, solution D-3 was added. the temperature was raised to 60° C. in 31 min., solution G-3 was further added, the pH was adjusted to 9.3 with solution H-3, and ripening was carried out for a period of 6.5 min. Thereafter, the pH was adjusted to 5.8 with solution F-3, then, remaining solutions B-3 and C-3 were added by double jet addition at an accelerated flow rate for 37 min., and the resulting emulsion was immediately desalted. As a result of electron microscopic observation, the thus obtained seed emulsion was comprised of monodisperse tabular grains having two parallel twin planes, an average grain size (equivalent circular diameter) of 0.72 $\mu$m and a grain size distribution of 16%.

Preparation of Emulsion Em-6

Emulsion Em-6 was prepared using seed emulsion T-1 and the following solutions.

| | | |
|---|---|---|
| Solution A-4 | | |
| Ossein gelatin | 25.0 | g |
| Surfactant (EO-1, 10 wt % methanol solution) | 2.5 | ml |
| Seed emulsion T-1 | 0.9 | mol. equivalent |
| Water to make | 3500 | ml |
| Solution B-4 | | |
| 3.5N aqueous silver nitrate solution | 4407 | ml |
| Solution C-4 | | |
| 3.5N Aqueous potassium bromide solution | 5000 | ml |
| Solution D-4 | | |
| 1.0N Aqueous silver nitrate solution | 620 | ml |
| Solution E-4 | | |
| 1.0N Aqueous potassium iodide solution | 620 | ml |

-continued

| | |
|---|---|
| Solution F-4 | |
| Fine grain emulsion containing silver iodide fine grains (av. size of 0.05 μm) | 0.70 mol |

The fine grain emulsion (F-4) was prepared in the following manner. To 5000 ml of an aqueous 6 wt % gelatin solution containing 0.06 mol potassium iodide, an aqueous solution containing 7.06 mol silver nitrate and an aqueous solution containing 7.06 mol potassium iodide, each 2000 ml were added at a constant flow rate. for 10 min., while the pH and temperature were controlled at 2.0 and 40° C., respectively. After completion of addition, the pH was adjusted to 6.0 with aqueous sodium carbonate solution.

| | |
|---|---|
| Solution C-4 | |
| Aqueous solution containing $8 \times 10^{-3}$ mol thiourea dioxide | 50 ml |
| Solution H-4 | |
| Aqueous solution containing $5.2 \times 10^{-3}$ mol of sodium ethanethiosulfonate | 100 ml |

To a reaction vessel, solution A-4 was added, then, solution G-4 was added, and solutions B-4, C-4 and F-4 were added by triple jet addition at an accelerated flow rate so that no nucleation occurred, while vigorously stirring and maintaining the pAg at 0.5. Solution F-4 was added with maintaining a constant molar ratio of solution F 4 to solution B-4 and addition of the total amount of solution F-4 was completed at the time when 2.1 lit. of solution B-4 (equivalent to 50% of total silver necessary to form grains) was added. Addition of solutions B-4 and C-4 was interrupted at this moment, the temperature was lowered to 60° C., and then solutions D-4 and E-4 were added at a constant flow rate for 2 min. Thereafter, addition of solutions B-4 and C-4 was started and remaining solution B-4 was added while maintaining the pAg at 9.4. After completion of addition of solution B-4, solution H-4 was added and ripening was conducted for 20 min. During addition of solution B-4 was optionally used 1.75N aqueous potassium bromide solution. After completion of adding solution B 4, the emulsion was desalted using phenylcarbamyl gelatin (substitutional rate of amino group of 90%) in accordance with the method described in JP-A 5-72658. Subsequently, the emulsion was redispersed by adding gelatin and the pH and pAg were adjusted to 5.80 and 8.06 at 40° C., respectively. As a result of electron microscopic observation of silver halide grains of the thus obtained emulsion, 97% by number of total grain was accounted for by hexagonal tabular grains having two twin planes parallel to the major faces and dislocation lines in the fringe portion, and 50% by number of total grains was accounted for by tabular grains having an average grain diameter of 1.9 μm, a grain size distribution of 11%, an average aspect ratio of 4.0 and at least 10 dislocation lines in the fringe portion. The average iodide content ($I_2$) of the silver halide grains was 8 mol %.

Preparation of Emulsion Em-6A

Emulsion Em-6 was each heated to 52° C., and adding sensitizing dye SD-12 of $4.7\times10^{-5}$ mol per mol of silver halide, SD-15 of $2.0\times10^{-4}$ mol per mol of silver halide, triphenylphosphine selenide of $2.5\times10^{-6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate penta-hydrate of $5.5\times10^{-6}$ mol per mol of silver halide, the emulsion was ripened at a silver potential of 90 mV and a pH of 5.5 so as to achieve optimum sensitivity. After completion of ripening, $7.5\times10^{-3}$ mol per mol of silver halide of 6-methyl-4-hydroxy-1,3,3a,7-tetrazaindene and $2.5\times10^{-4}$ mol per mol of silver halide of 1l-phenyl-5-mercaptotetrazole were added and the emulsion was cooled to be set to obtain silver halide emulsion Em-6A.

Preparation of Emulsion Em-6B

Emulsion Em 6 was each heated to 52° C. and adding sensitizing dye SD-12 of $4.7\times10^{-5}$ mol per mol of silver halide, SD-15 of $2.0\times10^{-4}$ mol per mol of silver halide, triphenylphosphine selenide of $2.5\times10^{-6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate penta-hydrate of $5.5\times10^{6}$ mol per mol of silver halide, the emulsion was ripened at a silver potential of 90 mV and a pH of 6.3 so as to achieve optimum sensitivity. After completion of ripening, $7.5\times10^{-3}$ mol per mol of silver halide of 6-methyl-4-hydroxy-1,3,3a,7-tetrazaindene and $2.0\times10^{-4}$ mol per mol of silver halide of compound (1–6) were added and the emulsion was cooled to be set to obtain silver halide emulsion Em 6B.

Multi-layered color photographic material samples 1101 through 1407 were prepared similarly to those of Examples 3, provided that silver iodobromide emulsion f used in the 12th layer was replaced by emulsion Em-6A or Em-6B. Further, sensitivity stability and graininess stability were similarly determined for each sample with respect to yellow, magenta and cyan, and evaluation was made based on the average of yellow, magenta and cyan sensitivity stabilities and the average of yellow, magenta and cyan graininess stabilities.

Samples and evaluation results thereof are shown in Table 7.

TABLE 7

| Sample No. | Emulsion A (9th Layer) | Emulsion a (5th Layer) | Emulsion f (12th Layer) | Emulsion B (8th Layer) | [(PGb/Sb) + (PGg/Sg) + (PGr/Sr)]/3 | Sensitivity Stability (average) | Graininess Stability (average) |
|---|---|---|---|---|---|---|---|
| 1401 (Comp.) | Em-1A | Em-1A2 | Em-6A | Em-5 | 122 | 75 | 74 |
| 1403 (Inv.) | Em-2A | Em-2A2 | Em-6B | Em-5 | 92 | 92 | 90 |
| 1404 (Inv.) | Em-3A | Em-3A2 | Em-6B | Em-5 | 87 | 94 | 92 |

TABLE 7-continued

| Sample No. | Emulsion A (9th Layer) | Emulsion a (5th Layer) | Emulsion f (12th Layer) | Emulsion B (8th Layer) | [(PGb/Sb) + (PGg/Sg) + (PGr/Sr)]/3 | Sensitivity Stability (average) | Graininess Stability (average) |
|---|---|---|---|---|---|---|---|
| 1405 (Inv.) | Em-4A | Em-4A2 | Em-6B | Em-5 | 80 | 96 | 95 |
| 1406 (Inv.) | Em-4B | Em-4B2 | Em-6B | Em-5 | 70 | 98 | 97 |
| 1407 (Inv.) | Em-4B | Em-4B2 | Em-6B | Em-6 | 65 | 99 | 99 |

As apparent from Table 7, Samples 1403 through 1407 relating to the invention exhibited superior results in sensitivity stability to radiation and graininess stability to radiation, relative to comparative Sample 1401.

Example 6

Multi-layered color photographic material samples 1501 through 1507 were prepared similarly to those of Examples 4, provided that silver iodobromide emulsion i used in the 12th layer was replaced by emulsion Em-6A or Em-6B prepared in Example 5. Further, sensitivity stability and graininess stability were similarly determined for each sample with respect to yellow, magenta and cyan, and evaluation was made based on the average of yellow, magenta and cyan sensitivity stabilities and the average of yellow, magenta and cyan graininess stabilities.

Samples and evaluation results thereof are shown in Table 8.

TABLE 8

| Sample No. | Emulsion E (9th Layer) | Emulsion e (5th Layer) | Emulsion i (12th Layer) | Emulsion C (8th Layer) | [(PGb/Sb) + (PGg/Sg) + (PGr/Sr)]/3 | Sensitivity Stability (average) | Graininess Stability (average) |
|---|---|---|---|---|---|---|---|
| 1501 (Comp.) | Em-1A | Em-1A2 | Em-6A | Em-5 | 126 | 74 | 76 |
| 1503 (Inv.) | Em-2A | Em-2A2 | Em-6B | Em-5 | 90 | 91 | 90 |
| 1504 (Inv.) | Em-3A | Em-3A2 | Em-6B | Em-5 | 82 | 93 | 94 |
| 1505 (Inv.) | Em-4A | Em-4A2 | Em-6B | Em-5 | 76 | 96 | 96 |
| 1506 (Inv.) | Em-4B | Em-4B2 | Em-6B | Em-5 | 66 | 98 | 97 |
| 1507 (Inv.) | Em-4B | Em-4B2 | Em-6B | Em-6 | 60 | 99 | 99 |

As apparent from Table 8, Samples 1503 through 1507 relating to the invention exhibited superior results in sensitivity stability to radiation and graininess stability to radiation, relative to comparative Sample 1501.

Example 7

Preparation of Emulsion Em-1C

Emulsion Em 1 was each heated to 56° C. and adding sensitizing dye SD-8 of $2.7\times10^{-4}$ mol per mol of silver halide, SD-9 of $1.5\times10^{-5}$ mol per mol of silver halide, SD-10 of $1.7\times10^{-4}$ mol per mol of silver halide, triphenylphosphine selenide of $2.0\times10^{-6}$ mol per mol of silver halide, chloroauric acid of $3.2\times10^{-6}$ mol per mol of silver halide, potassium thiocyanate of $3.5\times10^{4}$ mol per mol of silver halide and sodium thiosulfate penta-hydrate of $4.5\times10^{-6}$ mol per mol of silver halide, the emulsion was ripened at a silver potential of 100 mV and a pH of 5.5 so as to achieve optimum sensitivity. After completion of ripening, $7.5\times'0^{-3}$ mol per mol of silver halide of 6 methyl 4 hydroxy-1,3,3a,7-tetrazaindene and $2.5\times10^{-4}$ mol per mol of silver halide of 1-phenyl-5-mercaptotetrazole were added and the emulsion was cooled to be set to obtain silver halide emulsion Em-1C.

Preparation of Emulsion Em-3C

Emulsion Em-3 was each heated to 52° C. and adding sensitizing dye SD-8 of $3.0\times10^{-4}$ mol per mol of silver halide, SD-9 of $2.0\times10^{-5}$ mol per mol of silver halide, SD-10 of $2.0\times10^{-5}$ mol per mol of silver halide, triphenylphosphine selenide of $2.5\times10^{-6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate penta-hydrate of $5.5\times10^{-6}$ mol per mol of silver halide, the emulsion was ripened at a silver potential of 60 mV and a pH of 6.5 so as to achieve optimum sensitivity. After completion of ripening, $7.5\times10^{-3}$ mol per mol of silver halide of 6-methyl-4-hydroxy-1,3,3a,7-tetrazaindene and $2.0\times10^{-4}$ mol per mol of silver halide compound (1–6) were added and the emulsion was cooled to be set to obtain silver halide emulsion Em 3C.

Preparation of Emulsion Em-4C

Emulsion Em-4 was each heated to 52° C. and adding sensitizing dye SD-8 of $4.0\times10^{-4}$ mol per mol of silver halide, SD-9 of $2.4\times10^{-5}$ mol per mol of silver halide, SD-10 of $2.4\times10^{-5}$ mol per mol of silver halide, triphenylphosphine selenide of $3.0\times10^{6}$ mol per mol of silver halide, chloroauric acid of $3.2\times10^{-6}$ mol per mol of silver halide, potassium thiocyanate of $3.5\times10^{-4}$ mol per mol of silver halide and sodium thiosulfate penta-hydrate of $5.5\times10^{-6}$ mol per mol of silver halide, the emulsion was ripened at a silver potential of 60 mV and a pH of 6.5 so as to achieve optimum sensitivity. After completion of ripening, $7.5\times10^{-3}$ mol per mol of silver halide of 6-methyl-4 hydroxy 1,3,3a,7-tetrazaindene and $2.0\times10^{-4}$ mol per mol of silver halide of compound (1–6) were added and the emulsion was cooled to be set to obtain silver halide emulsion Em-4C.

Multi-layered color photographic material samples 1601 through 1604 were prepared similarly to those of Examples 1, provided that emulsion A used in the 9th layer was replaced by any one of the foregoing emulsion Em-1C, Em3-C and Em-4C, and emulsion B used in the 8th layer was replaced by emulsion Em-5 or Em-6 prepared in Example 1 and evaluated.

Samples and their evaluation results are shown in Table 9.

TABLE 9

| Sample No. | Emulsion A (9th Layer) | Emulsion B (8th Layer) | D1/D2 (9th Layer) | Sensitivity Stability (average) | Graininess Stability (average) |
|---|---|---|---|---|---|
| 1601 (Comp.) | Em-1C | Em-5 | 1.18 | 77 | 70 |
| 1602 (Inv.) | Em-3C | Em-5 | 0.72 | 91 | 90 |
| 1603 (Inv.) | Em-4C | Em-5 | 0.62 | 95 | 94 |
| 1604 (Inv.) | Em-4C | Em-6 | 0.54 | 98 | 98 |

As apparent from Table 9, Sample 1602 through 1604 relating to the invention exhibited superior results in sensitivity stability to radiation and graininess stability to radiation, relative to comparative Sample 1601.

Example 8

Multi-layered color photographic material samples 1701 through 1704 were prepared similarly to those of Examples 2, provided that emulsion E used in the 9th layer was replaced by any one of the foregoing emulsion Em-1C, Em-3C and Em-4C of Example 7, and emulsion C used in the 8th layer was replaced by emulsion Em-5 or Em-6 prepared in Example 1 and evaluated.

Samples and their evaluation results are shown in Table 10.

TABLE 10

| Sample No. | Emulsion A (9th Layer) | Emulsion B (8th Layer) | D1/D2 (9th Layer) | Sensitivity Stability (average) | Graininess Stability (average) |
|---|---|---|---|---|---|
| 1701 (Comp.) | Em-1C | Em-5 | 1.25 | 76 | 78 |
| 1702 (Inv.) | Em-3C | Em-5 | 0.75 | 91 | 92 |
| 1703 (Inv.) | Em-4C | Em-5 | 0.64 | 95 | 96 |
| 1704 (Inv.) | Em-4C | Em-6 | 0.51 | 99 | 98 |

As apparent from Table 10, samples 1702 through 1704 relating to the invention exhibited superior results in sensitivity stability to radiation and graininess stability to radiation, relative to comparative Sample 1701.

What is claimed is:

1. A silver halide emulsion comprising silver halide grains, wherein at least 50% of total grain projected area is accounted for by tabular grains having dislocation lines in the fringe portion, the tabular grains each comprising an internal region and a shell (V1);

the internal region comprising a silver halide phase (V3) having a maximum average iodide content, a silver halide phase (V6) located inside the silver halide phase (V3) and having an average iodide content of A6 mol %, and a silver halide phase (V7) located outside the silver halide phase (V3) and having an average iodide content of A7 mol %, and the following requirement being met:

$$0\leqq A6/A7\leqq 1.0,$$

the shell (V1) accounting for 10 to 50% by volume of the grain and having an average iodide content of 4 to 20 mol %, the shell (V1) comprising one or more sub-shells including an outermost sub-shell (V2), the outermost sub-shell (V2) accounting for 1 to 15% by volume of the grain and having an average iodide content of 0 to 3 mol %.

2. The silver halide emulsion of claim 1, wherein the tabular grains have an aspect ratio of 2 or more.

3. The silver halide emulsion of claim 1, wherein the tabular grains have an average aspect ratio of 8 to 100.

4. The silver halide emulsion of claim 1, wherein the tabular grains have an average grain thickness of not less than 0.01 $\mu$m and less than 0.7 $\mu$m.

5. The silver halide emulsion of claim 1, wherein the silver halide phase (V3) has an average iodide content of not less than 20 mol %.

6. The silver halide emulsion of claim 1, wherein the silver halide phase (V3) is located external to 60% of the grain volume and internal to 80% of the grain volume.

7. The silver halide emulsion of claim 1, wherein A6 is 0 to 12 and A7 is 3 to 20.

8. The silver halide emulsion of claim 1, wherein at least 50% by number of the tabular grains meet I3>I4, wherein I3 is an average iodide content of an outermost surface layer in major faces and I4 is an average iodide content of an outermost surface layer in side faces.

9. The silver halide emulsion of claim 1, wherein the emulsion has been chemically sensitized at a silver potential of 30 to 70 mV and a pH of 6.0 to 7.0 with at least one selected from the group consisting of selenium compounds and tellurium compounds, the emulsion further containing a compound represented by the following formula (1)

$$R1-(S)m-R2$$

wherein R1 and R2 each represent an aliphatic group, aromatic group, heterocyclic group, or R1 and R2 combine with each other to form a ring; and m is an integer of 2 to 6.

10. A silver halide color photographic light-sensitive material comprising a support having thereon a blue-sensitive silver halide emulsion layer, a green sensitive silver halide emulsion layer and a red-sensitive silver halide emulsion layer, wherein at least one of the blue-sensitive, green-sensitive and red-sensitive layers comprise a silver halide emulsion comprising silver halide grains, wherein at least 50% of total grain projected area is accounted for by tabular grains having dislocation lines in the fringe portion, the tabular grains each comprising an internal region and a shell (V1);

the internal region comprising a silver halide phase (V3) having a maximum average iodide content, a silver halide phase (V6) located inside the silver halide phase (V3) and having an average iodide content of A6 mol %, and a silver halide phase (V7) located outside the silver halide phase (V3) and having an average iodide content of A7 mol %, and the following requirement being met:

$$0 \leqq A6/A7 \leqq 0$$

the shell (V1) accounting for 10 to 90% by volume of the grain and having an average iodide content of 4 to 20 mol %, the shell (V1) comprising plural sub-shells including an outermost sub-shell (V2), the outermost sub-shell (V2) accounting for 1 to 15% by volume of the grain and having an average iodide content of 0 to 3 mol %.

11. The color photographic material of claim 10, wherein the blue sensitive, green sensitive and red-sensitive layers comprise a yellow dye-forming coupler, a magenta dye-forming coupler and a cyan dye-forming coupler, respectively; the photographic material meeting the following requirement with respect to at least one of yellow, magenta and cyan densities:

$$10 \leqq PG/S \leqq 75$$

wherein PG represents an RMS granularity in a minimum density area and S represents a substantial fog.

12. The color photographic material of claim 10, wherein the blue-sensitive, green-sensitive and red-sensitive layers comprise a yellow dye-forming coupler, a magenta dye-forming coupler and a cyan dye forming coupler, respectively; the photographic material meeting the following requirement with respect to magenta and cyan densities:

$$10 \leqq \{(PGg/Sg)+(PGr/Sr)\}/2 \leqq 80$$

wherein PGg and PGr represent a RMS granularity in a minimum density area for magenta and cyan densities, respectively; Sg and Sr represent a substantial fog for magenta and cyan densities, respectively.

13. The color photographic material of claim 10, wherein the blue-sensitive, green-sensitive and red-sensitive layers comprise a yellow dye-forming coupler, a magenta dye forming coupler and a cyan dye forming coupler, respectively; the photographic material meeting the following requirement with respect to yellow, magenta and cyan densities:

$$10 \leqq \{(PGb/Sb)+(PGg/Sg)+(PGr/Sr)\}/3 \leqq 100$$

where PGb, PGg and PGr represent a RMS granularity in a minimum density area for yellow, magenta and cyan densities, respectively; Sb, Sg and Sr represent a substantial fog of yellow, magenta and cyan densities, respectively.

14. The color photographic material of claim 10, wherein at least one of the blue-sensitive, green-sensitive and red-sensitive layers meets the following requirement:

$$0.1 \leqq D1/D2 \leqq 0.8$$

wherein D1 represents a mean size of developed silver in a minimum density area and D2 represents a mean size of developed silver in a portion exhibiting a color density of a minimum density plus 0.15.

* * * * *